US011733635B2

(12) United States Patent
Yoshida

(10) Patent No.: US 11,733,635 B2
(45) Date of Patent: Aug. 22, 2023

(54) IMAGE FORMING APPARATUS

(71) Applicant: CANON KABUSHIKI KAISHA, Tokyo (JP)

(72) Inventor: Atsushi Yoshida, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 189 days.

(21) Appl. No.: 17/236,063

(22) Filed: Apr. 21, 2021

(65) Prior Publication Data

US 2021/0356898 A1 Nov. 18, 2021

(30) Foreign Application Priority Data

May 18, 2020 (JP) ..... 2020-086421

(51) Int. Cl.
*G03G 15/00* (2006.01)

(52) U.S. Cl.
CPC ..... *G03G 15/6576* (2013.01)

(58) Field of Classification Search
CPC ..... G03G 15/6576
See application file for complete search history.

(56) References Cited

U.S. PATENT DOCUMENTS 5,565,971 A * 10/1996 Kuo ..... B65H 29/12 162/197
6,259,884 B1 * 7/2001 Oberhoffner ..... G03G 15/238 399/361
7,298,981 B2 * 11/2007 Oohara ..... G03G 15/2028 399/45
9,370,940 B1 * 6/2016 LeFevre ..... B41J 11/0005
2005/0195271 A1 * 9/2005 Denawa ..... G03D 13/002 347/228
2006/0087546 A1 * 4/2006 Tsuji ..... B41J 11/70 347/104
2009/0116890 A1 * 5/2009 Kawachi ..... G03G 15/6576 399/406
2009/0278304 A1 * 11/2009 Hara ..... B65H 7/02 271/265.01
2011/0205323 A1 * 8/2011 Satoh ..... B65H 29/60 271/301
2012/0112400 A1 * 5/2012 Otsuki ..... G03G 15/0173 271/3.19
2012/0114342 A1 * 5/2012 Maeda ..... G03G 15/205 399/20

(Continued)

FOREIGN PATENT DOCUMENTS

JP 2006-182475 A 7/2006

*Primary Examiner* — David H Banh
(74) *Attorney, Agent, or Firm* — Venable LLP

(57) ABSTRACT

An image forming apparatus includes a control unit to perform a first conveyance process in which a sheet is conveyed in a second direction opposite to a first direction at a first speed by a reverse conveyance roller pair, a second conveyance process in which the sheet is conveyed at a second speed by a decurler, and a third conveyance process in which the sheet is conveyed to an inlet roller pair at a third speed by a conveyance roller pair, with the second speed being slower than the first speed, and the third speed being different from the first and second speeds. An image forming unit conveys the sheet at a fourth speed while transferring the image onto the sheet, the fourth speed being slower than the first speed, the second speed, and the third speed.

10 Claims, 15 Drawing Sheets

(56) References Cited

U.S. PATENT DOCUMENTS

| | | | | |
|---|---|---|---|---|
| 2015/0241833 | A1* | 8/2015 | Soda | B41J 11/0005 399/406 |
| 2021/0009376 | A1 | 1/2021 | Takezawa et al. | |
| 2021/0032064 | A1 | 2/2021 | Hayashi et al. | |
| 2021/0356898 | A1* | 11/2021 | Yoshida | G03G 15/6576 |

* cited by examiner

IMAGE FORMING APPARATUS

BACKGROUND OF THE INVENTION

Field of the Invention

The present invention relates to an image forming apparatus which forms an image on a sheet.

Description of the Related Art

Hitherto, as described in Japanese Patent Laid-Open No. 2006-182475, an image forming apparatus which includes a straight discharge mode in which a sheet is directly discharged after an image has been formed on the sheet and a switchback discharge mode in which the sheet is discharged after switchbacking so as to invert front and back surfaces of the sheet is suggested.

In the switchback discharge mode, it is necessary to temporarily stop a conveyance to invert leading and trailing edges of the sheet. Therefore, the switchback discharge mode requires more time than the straight discharge mode. At this point, so as to equalize discharge productivity of the apparatus in the straight and switchback discharge modes, it is necessary to accelerate the sheet after an inversion in the switchback discharge mode.

Further, there are cases where the sheet discharged from the image forming apparatus is delivered to a post processing unit to fold the sheet and to punch a hole in the sheet. In these cases, since discharge speeds by the straight and switchback discharge modes are required to match each other, it is necessary to decelerate the accelerated sheet in the switchback discharge mode.

Further, an apparatus which includes a decurler unit correcting a curl of the sheet at a discharge of the sheet from the image forming apparatus is suggested.

However, in the apparatus including the decurler unit, in a case where the sheet is conveyed to the decurler unit with a sheet conveyance speed accelerated, it occurs that a motor driving the decurler unit is applied with an excessive load and falls out of step. Further, if the sheet accelerated after the inversion is decelerated to a low sheet discharge speed before reaching the decurler unit, sheet discharge productivity is decreased.

SUMMARY OF THE INVENTION

According to one aspect of the present invention, an image forming apparatus coupled to a downstream apparatus and delivering a sheet to an inlet roller pair provided on the downstream apparatus, the image forming apparatus includes an image forming unit configured to form an image on the sheet, a reverse conveyance roller pair configured to convey the sheet in a first direction, and thereafter convey the sheet in reverse in a second direction opposite to the first direction so as to switchback the sheet on which the image is formed by the image forming unit, a decurler roller pair configured to correct a curl of the sheet conveyed by the reverse conveyance roller pair and convey the sheet, a conveyance roller pair configured to convey the sheet whose curl is corrected by the decurler roller pair toward the inlet roller pair, and a control unit configured to control rotational speeds of the reverse conveyance roller pair, the decurler roller pair, and the conveyance roller pair. The control unit is configured to perform a first conveyance process in which the sheet is conveyed in the second direction at a first speed by the reverse conveyance roller pair, a second conveyance process in which the sheet is conveyed at a second speed by the decurler roller pair, and a third conveyance process in which the sheet is conveyed to the inlet roller pair at a third speed by the conveyance roller pair, the second speed being slower than the first speed, the third speed being different from the first and second speeds.

Further features of the present invention will become apparent from the following description of exemplary embodiments with reference to the attached drawings.

DESCRIPTION OF THE EMBODIMENTS

First Embodiment

Overall Configuration

At first, a first embodiment of this disclosure will be described. A printer 1, serving as an image forming apparatus, is a full color laser beam printer of an electrophotographic system. The printer 1 is coupled to a discharge accessory 120, serving as a downstream apparatus, and delivers a sheet to an inlet roller pair 121 provided on the discharge accessory 120.

Figure 1:
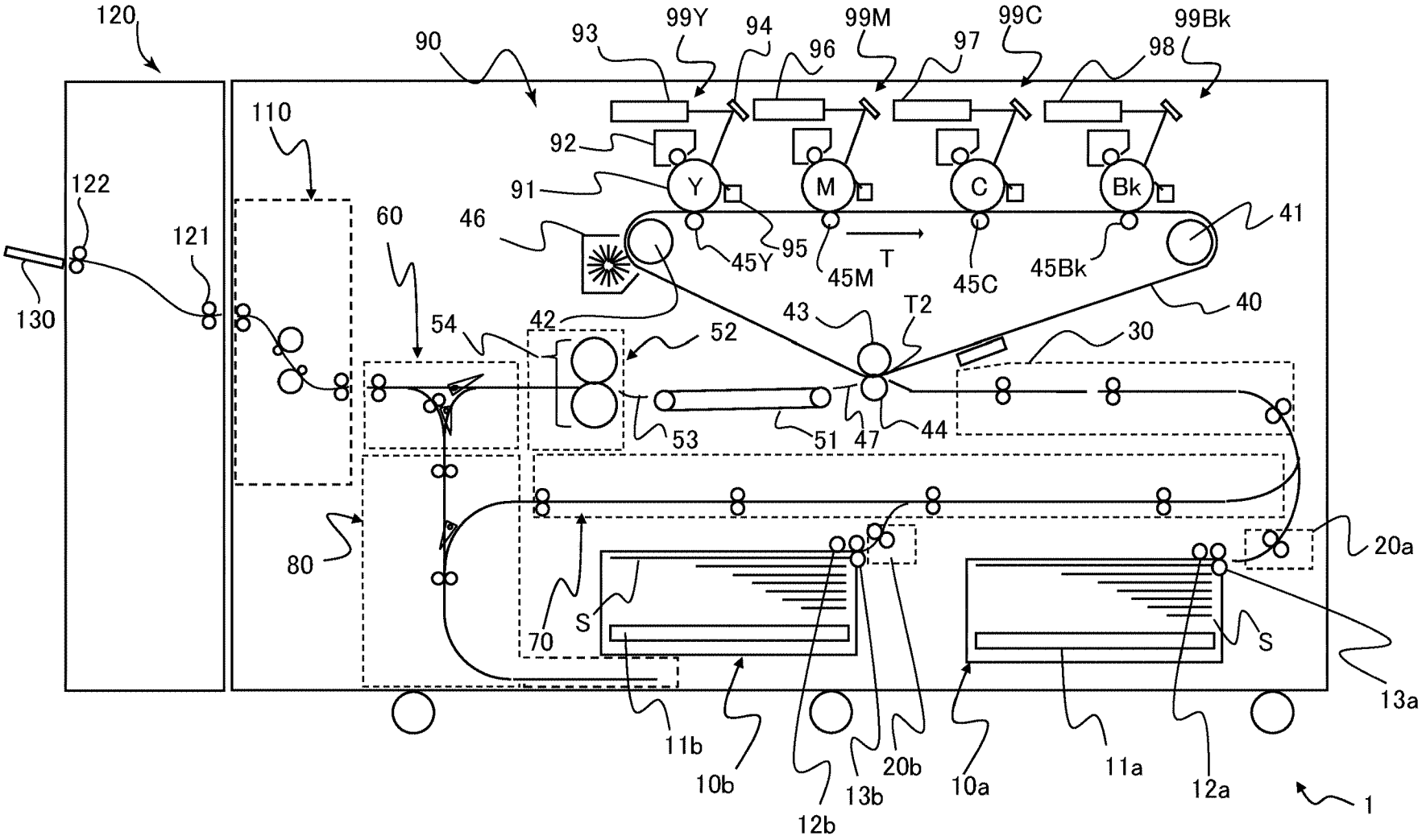
FIG. 1 is a diagram showing a schematic general view of a printer according to a first embodiment.

The printer 1, as shown in FIG. 1, includes sheet feed units 10*a* and 10*b*, drawing out units 20*a* and 20*b*, a registration unit 30, an image forming unit 90, a fixing unit 52, and a branch conveyance unit 60. Further, the printer 1 includes a decurler unit 110, an inverse conveyance unit 80, and a duplex conveyance unit 70.

The image forming unit 90 includes four process cartridges 99Y, 99M, 99C, and 99Bk which respectively form four colors of yellow (Y), magenta (M), cyan (C), and black (K) of toner images, and exposing units 93, 96, 97, and 98. To be noted, configurations of four process cartridges 99Y, 99M, 99C, and 99Bk are the same except for differences in colors with which the toner images are formed. Therefore, only the configuration and an image forming process of the process cartridge 99Y will be described, and descriptions of the process cartridges 99M, 99C, and 99Bk will be omitted herein.

The process cartridge 99Y includes a photosensitive drum 91, a charge roller, not shown, a development unit 92, and a cleaner 95. The photosensitive drum 91 is constituted by coating an organic photoconductive layer on an outer periphery of an aluminum cylinder, and rotatably driven by a drive roller, not shown. Further, in the image forming unit 90, an intermediate transfer belt 40 rotatably driven by a drive roller 42 in an arrow T direction is disposed, and wound around a tension roller 41, the drive roller 42, and a secondary transfer inner roller 43. Inside the intermediate transfer belt 40, primary transfer rollers 45Y, 45M, 45C, and 45Bk are disposed, and, outside the intermediate transfer belt 40, a secondary transfer outer roller 44 is disposed facing the secondary transfer inner roller 43.

The fixing unit 52 includes a fixing roller pair 54 and a pre-fixing guide 53 guiding the sheet to a nip portion of the fixing roller pair 54. The sheet feed unit 10*a* includes a lift plate 11*a* which ascends and descends while stacking the sheet S, a pickup roller 12*a* which feeds the sheet S stacked on the lift plate 11*a*, and a separation roller pair 13*a* which separates the fed sheet into one sheet at a time. Similarly, the sheet feed unit 10*b* includes a lift plate 11*b* which ascends and descends while stacking the sheet S, a pickup roller 12*b* which feeds the sheet S stacked on the lift plate 11*b*, and a separation roller pair 13*b* which separates the fed sheet into one sheet at a time.

Next, an image forming operation of the printer 1 configured as described above will be described. When an image signal is input to an exposing unit 93 from a personal computer, not shown, and the like, a laser beam is irradiated on the photosensitive drum 91 of the process cartridge 99Y from the exposing unit 93 in accordance with the image signal.

At this time, a surface of the photosensitive drum 91 is beforehand uniformly charged in predetermined polarity and electric potential by the charge roller, and an electrostatic latent image is formed on the surface by being irradiated with the laser beam by the exposing unit 93 via a mirror 94. The electrostatic latent image formed on the photosensitive drum 91 is developed by the development unit 92, and the toner image of yellow is formed on the photosensitive drum 91.

Similarly, each of the photosensitive drums of the process cartridges 99M, 99C, and 99Bk is irradiated with the laser beam by exposing units 96, 97, and 98, and the toner images of magenta (M), cyan (C), and black (K) are formed on each of the photosensitive drums. Each color of the toner images formed on each of the photosensitive drums is transferred onto the intermediate transfer belt 40 by the primary transfer rollers 45Y, 45M, 45C, and 45Bk. Then, a full color toner image is conveyed to a secondary transfer nip portion T2 formed by the secondary transfer inner and outer rollers 43 and 44 by the intermediate transfer belt 40 rotatably driven by the drive roller 42. A toner remaining on the photosensitive drum 91 is collected by the cleaner 95. To be noted, an image forming process of each color is carried out in a timing of which the toner image is superimposed on an upstream toner image primarily transferred onto the intermediate transfer belt 40.

In parallel with this image forming process, the sheet S is fed from either one of the sheet feed units 10*a* and 10*b*, and conveyed to the registration unit 30 by either one of the drawing out units 20*a* and 20*b*. A skew of the sheet S is corrected by the registration unit 30, and the sheet S is conveyed to the secondary transfer nip portion T2, serving as an image forming unit, in a predetermined conveyance timing. The full color toner image on the intermediate transfer belt 40 is transferred onto a first sheet surface (front surface) of the sheet S at the secondary transfer nip portion T2 by a secondary transfer bias applied by the secondary transfer outer roller 44. A residual toner remained on the intermediate transfer belt 40 is collected by a belt cleaner 46.

The sheet S with the toner image transferred is conveyed to the fixing unit 52 by a post-transfer guide 47 and a pre-fixing conveyance unit 51. Then, the sheet S is guided to the nip portion of the fixing roller pair 54 by the pre-fixing guide 53, and predetermined heat and pressure are provided so that the toner is melted and bonded (fixed). The branch conveyance unit 60 performs a path selection so that the sheet S passed through the fixing unit 52 is conveyed to either one of the decurler unit 110 and the inverse conveyance unit 80. To be noted, the branch and inverse conveyance units 60 and 80 are also capable of conveying the sheet S to the decurler unit 110 with inverting the sheet S so that the first sheet surface with the image formed at the secondary nip portion T2 becomes an underside.

In a case where the image is formed on one of the surfaces of the sheet S, the sheet S is conveyed from the branch conveyance unit 60 to the decurler unit 110, and a curl of the sheet is corrected by a small diameter hard roller and a large diameter soft roller. Subsequently, the sheet S passed through the decurler unit 110 is conveyed to the discharge accessory 120. Having provided the sheet S with a process, the discharge accessory 120 discharges the sheet S to a sheet discharge tray 130.

In a case where the image is formed on both the surfaces of the sheet S, the sheet S is conveyed to the inverse conveyance unit 80 by the branch conveyance unit 60, and is switchbacked at the inverse conveyance unit 80. The switchbacked sheet S is conveyed from the inverse conveyance unit 80 to the duplex conveyance unit 70, and guided to the registration unit 30. Subsequently, the image is formed on a second sheet surface (back surface) of the sheet S at the secondary transfer nip portion T2, and the sheet S is discharged to the sheet discharge tray 130 via the decurler unit 110 and the discharge accessory 120.

Configurations of Branch and Inverse Conveyance Units

Figure 2:
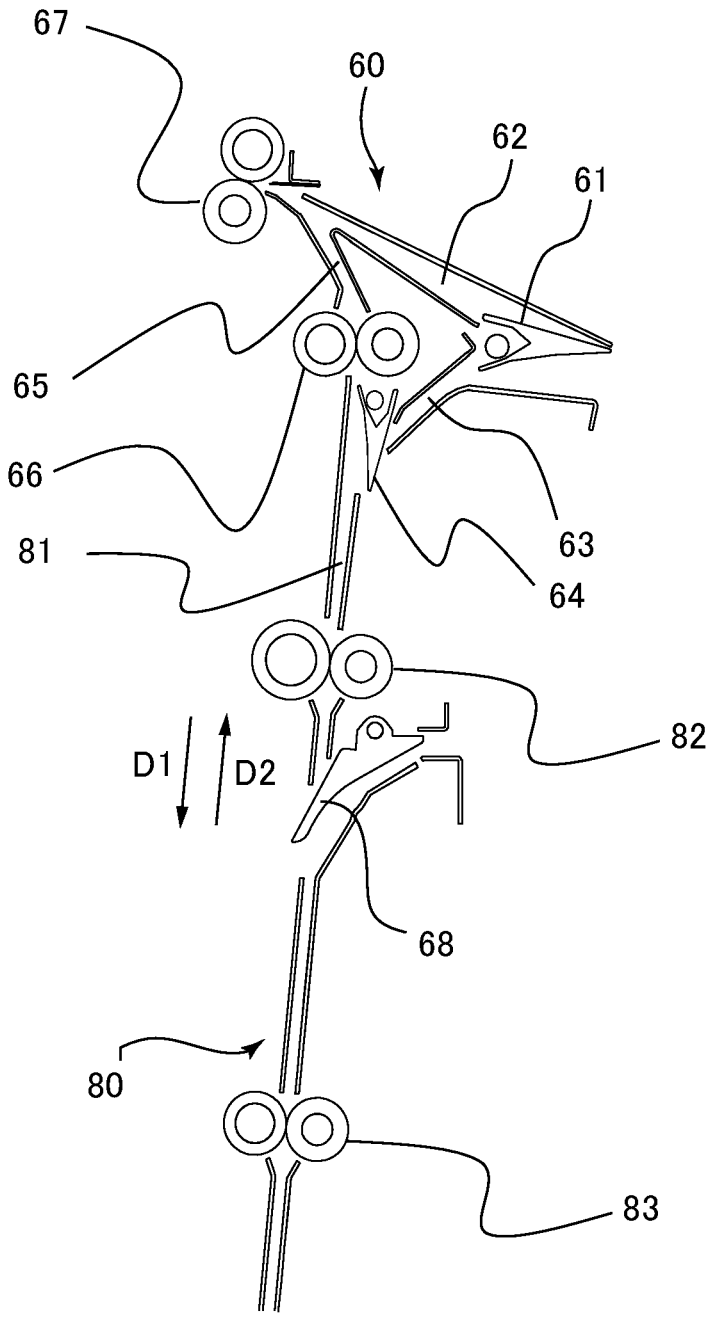
FIG. 2 is a cross-sectional view showing a branch and an inverse conveyance unit.

Next, configurations of the branch and inverse conveyance units 60 and 80 will be described. The branch conveyance unit 60 includes, as shown in FIGS. 1 and 2, a straight conveyance path 62 guiding the sheet S conveyed by the fixing unit 52 linearly and a pre-inverse conveyance path 63 branching off downwards from the straight conveyance path 62. The pre-inverse conveyance path 63 is coupled to an inverse conveyance path 81 extending downwards, and the inverse and straight conveyance paths 81 and 62 are communicated with each other by a post-inverse conveyance path 65.

At a branch portion of the straight and pre-inverse conveyance paths 62 and 63, a first switching member 61 is disposed. Being driven by a driving source, not shown, the first switching member 61 is capable of switching between positions to guide the sheet S passed through the fixing unit 52 to the straight conveyance path 62 and to the pre-inverse conveyance path 63.

At a branch portion of the pre-inverse and post-inverse conveyance paths 63 and 65, a second switching member 64 is disposed. The second switching member 64 is urged by an urging member, not shown, so that the second switching member 64 is in a state of being positioned to guide the sheet S passing the inverse conveyance path 81 to the post-inverse conveyance path 65. In a case where the sheet S has been conveyed from the fixing unit 52 to the pre-inverse conveyance path 63, the sheet S proceeds to the inverse conveyance path 81 while pressing the second switching member 64 with resisting an urging force of the urging member.

The inverse conveyance unit 80 is disposed along the inverse conveyance path 81, and includes an upper reverse conveyance roller pair 82 and a lower reverse conveyance roller pair 83, both of which are reverse conveyance roller pairs capable of rotating in normal and reverse directions. The upper and lower reverse conveyance roller pairs 82 and 83 are driven by the same driving source, and switchback the sheet. In other words, the upper and lower reverse conveyance roller pairs 82 and 83 switchback the sheet so that the sheet is conveyed in a first direction D1 and thereafter conveyed in a second direction D2 opposite to the first direction D1. Further, the inverse conveyance unit 80 is capable of performing face down discharge control which is inverse conveyance control to switchback the sheet to the inlet roller pair 121. A sheet pre-discharge roller pair 66 is provided on the post-inverse conveyance path 65, and a sheet discharge roller pair 67 conveying the sheet S to the decurler unit 110 is disposed at a merging portion of the straight and post-inverse conveyance paths 62 and 65.

Configuration of Decurler Unit

Figure 3:
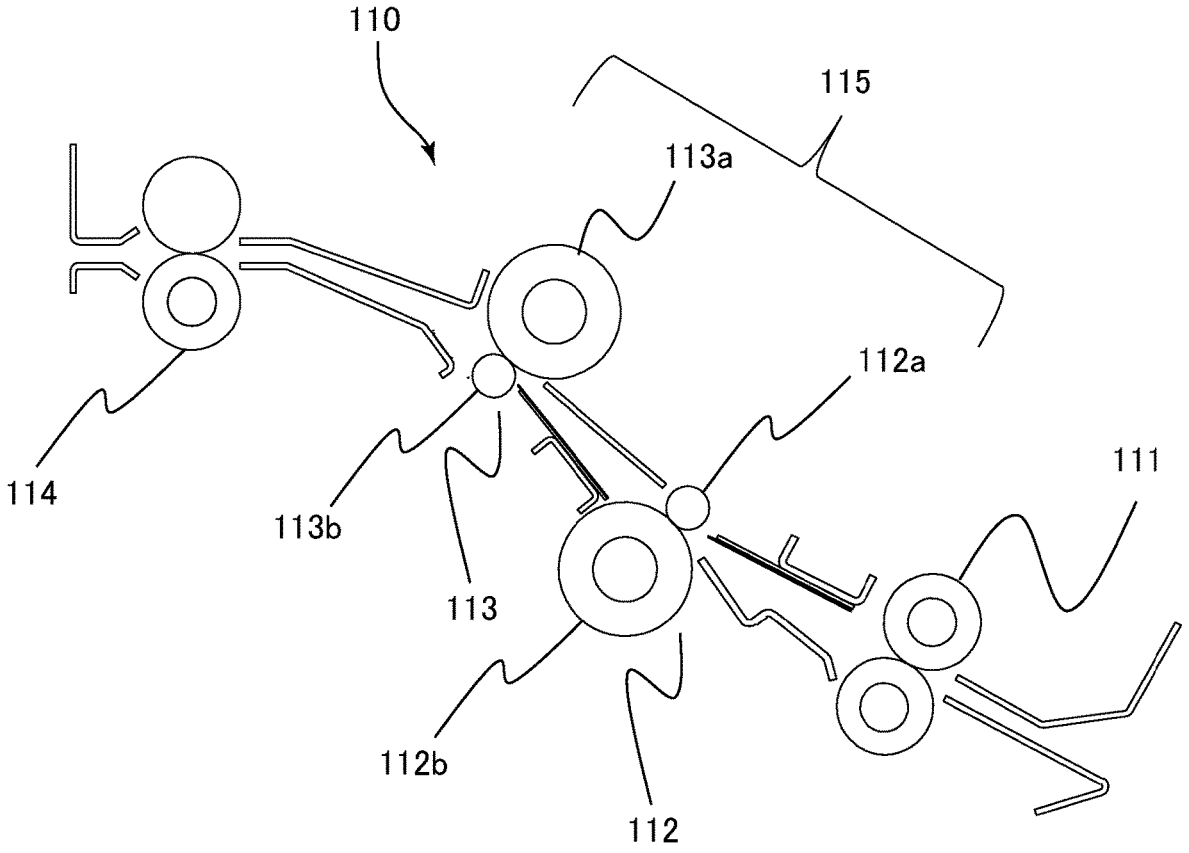
FIG. 3 is a cross-sectional view showing a decurler unit.

Next, a configuration of the decurler unit 110 will be described. The decurler unit 110 includes, as shown in FIG. 3, an upstream roller pair 111, a curl correction portion 115, and a downstream roller pair 114, serving as a conveyance roller pair. The upstream roller pair 111 receives the sheet S conveyed to the decurler unit 110 by the branch conveyance unit 60, and conveys the sheet S to the curl correction portion 115. The curl correction portion 115 corrects a curl of the sheet S, and conveys the sheet S to the downstream roller pair 114. The downstream roller pair 114 conveys the conveyed sheet S to the discharge accessory 120.

As shown in FIG. 3, the curl correction portion 115 includes upstream and downstream curl correction roller pairs 112 and 113, serving as decurler roller pairs. The upstream curl correction roller pair 112 includes an upstream metal roller 112*a* driven by a decurler motor M3 (refer to FIG. 4) and an upstream sponge roller 112*b*. The upstream metal roller 112*a*, serving as a first conveyance roller, is constituted by a metallic material, for example, such as a SUS (stainless steel), and the upstream sponge roller 112*b* is constituted by a soft elastic member, for example, such as a urethane foam. An outer diameter r2, which is a second outer diameter, of the upstream sponge roller 112*b* is larger than an outer diameter r1, which is a first outer diameter, of the upstream metal roller 112*a* (r2>r1). The upstream sponge roller 112*b* is pressed to the upstream metal roller 112*a* by a cam member, not shown, so that it is possible to vary pressing pressure corresponding to a direction and amount of the curl.

Similar to the upstream curl correction roller pair 112, the downstream curl correction roller pair 113 includes a downstream metal roller 113*b* driven by the decurler motor M3 (refer to FIG. 4) and a downstream sponge roller 113*a*. The downstream metal roller 113*b* is constituted by the metallic material, for example, such as the SUS, and the downstream sponge roller 113*a* is constituted by the soft elastic member, for example, such as the urethane foam. An outer diameter r3 of the upstream sponge roller 113*a* is larger than an outer diameter r4 of the downstream metal roller 113*b* (r3>r4). The downstream metal roller 113*b* is pressed to the downstream sponge roller 113*a* by a cam member, not shown, so that it is possible to vary the pressing pressure corresponding to the direction and amount of the curl.

By squeezing the sheet S through the upstream curl correction roller pair 112 and the downstream curl correction roller pair 113, the curl of the sheet S is corrected. The upstream metal roller 112*a* of the upstream curl correction roller pair 112 and the downstream sponge roller 113*a* of the downstream curl correction roller pair 113 are disposed opposite sides across a conveyance path. Therefore, it is possible to correct the curl in accordance with the direction of the curl by adjusting the pressing pressure of the upstream and downstream curl correction roller pairs 112 and 113 corresponding to the direction of the curl.

Control Block

Figure 4:
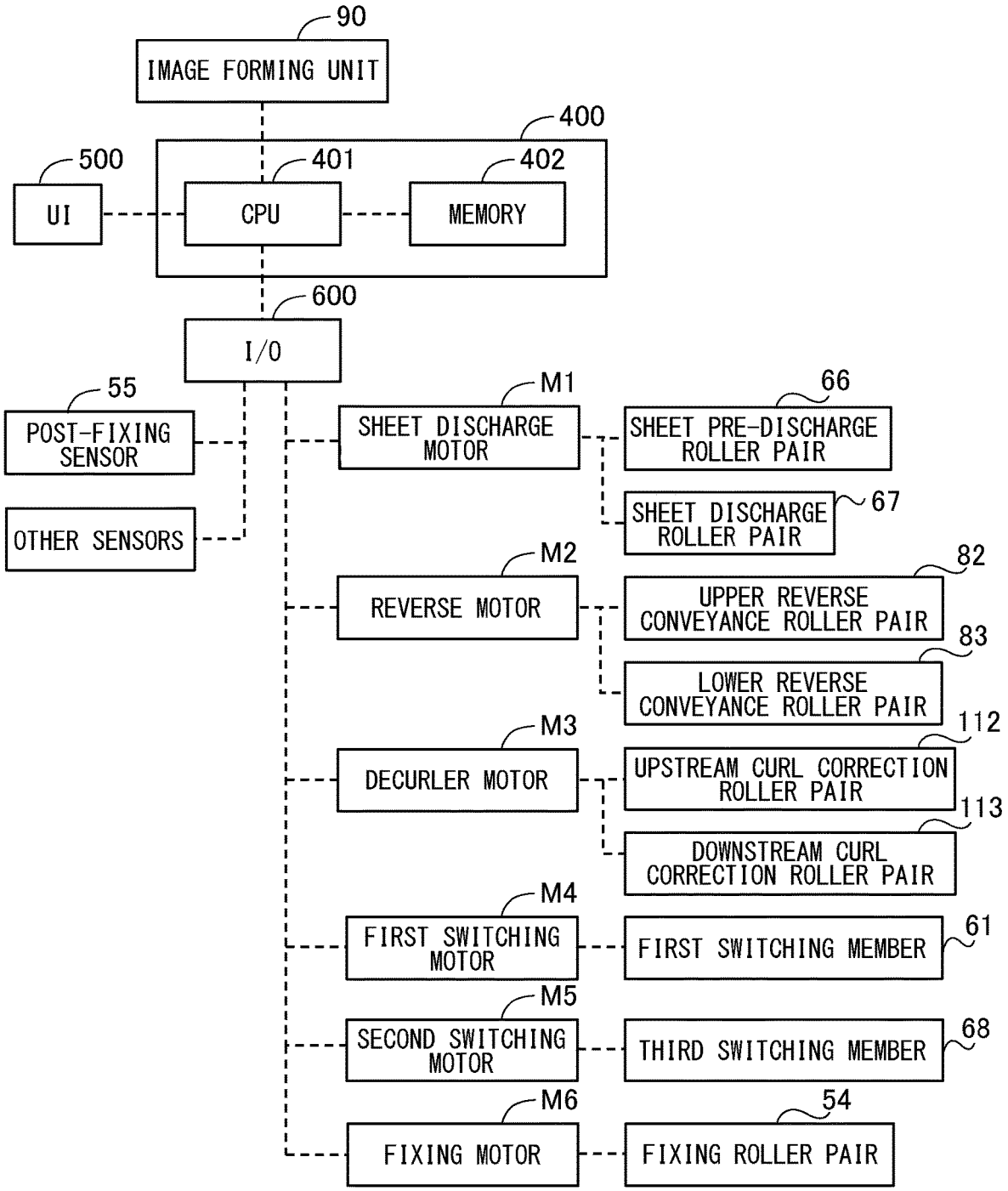
FIG. 4 is a block diagram showing a control block according to the first embodiment.

FIG. 4 is a control block diagram according to this embodiment. As shown in FIG. 4, a control unit 400 of the printer 1 includes a CPU (central processing unit) 401 and a memory 402. The CPU 401 reads various programs from the memory 402, and performs these programs. Further, the CPU 401 controls the image forming unit 90 and a UI (user interface) 500 such as an operation panel.

The control unit 400 is coupled to a post-fixing sensor 55 and the other sensors, a sheet discharge motor M1, a reverse motor M2, the decurler motor M3, a first switching motor M4, a second switching motor M5, and a fixing motor M6 via an I/O (input/output interface) 600. The post-fixing sensor 55 is disposed downstream of the fixing roller pair 54 in a sheet conveyance direction (refer to FIG. 5A).

The sheet discharge motor M1 drives the sheet pre-discharge roller pair 66 and the sheet discharge roller pair 67. The reverse motor M2 drives the upper and lower reverse conveyance roller pairs 82 and 83. The decurler motor M3 drives the upstream and downstream curl correction roller pairs 112 and 113. The first switching motor M4 drives the first switching member 61, and the second switching motor M5 drives the third switching member 68. The fixing motor M6 drives the fixing roller pair 54. To be noted, it is acceptable that the decurler motor M3 drives the upstream and downstream roller pairs 111 and 114 in addition to the upstream and downstream curl correction roller pairs 112 and 113.

Face Up Discharge Control

Figure 5A:
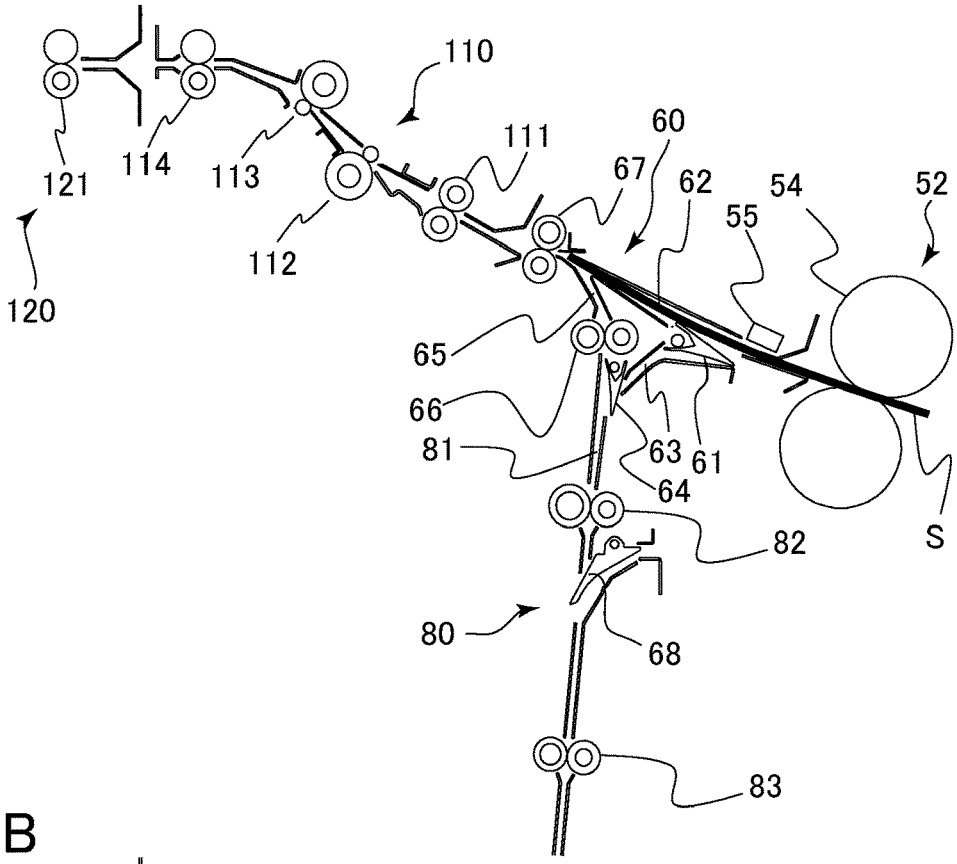
FIG. 5A is a cross-sectional view showing an aspect of a sheet in face up discharge control.
Figure 5B:
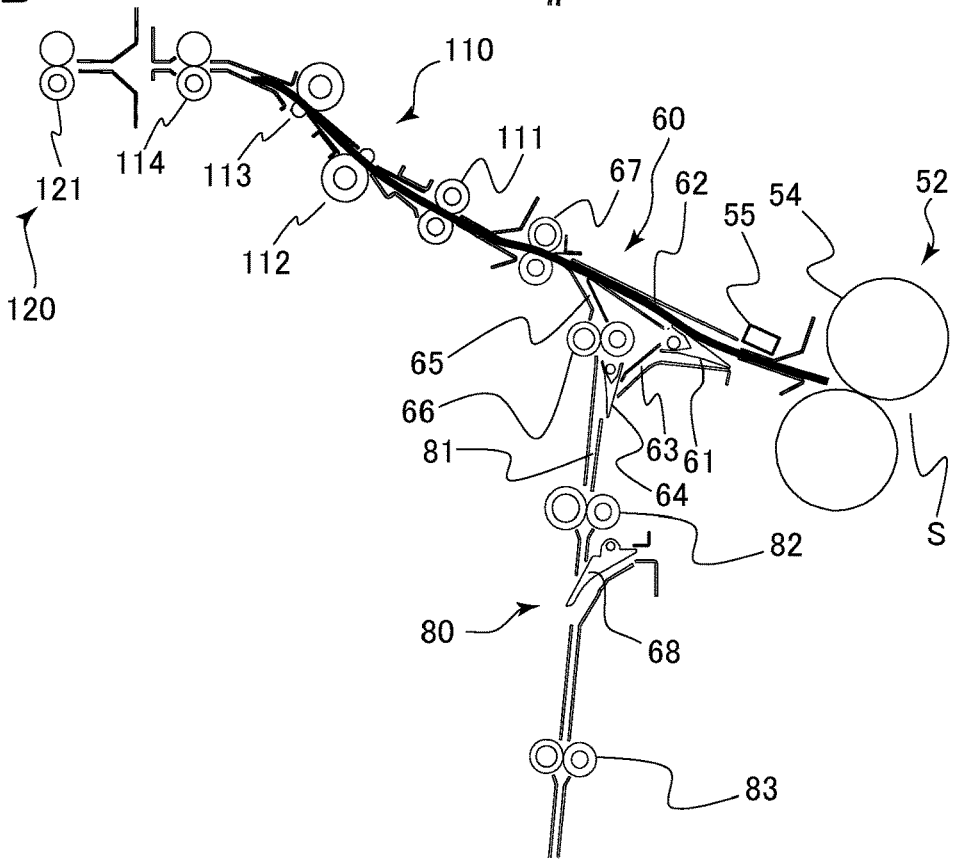
FIG. 5B is a cross-sectional view showing the aspect of the sheet in the face up discharge control.

Next, face up discharge control of this embodiment will be described. FIGS. 5A and 5B are partial cross-sectional views showing the fixing unit 52, the branch conveyance unit 60, the inverse conveyance unit 80, the decurler unit 110, and the discharge accessory 120. At first, as shown in FIG. 5A, the sheet S is conveyed while a visible color image is being fixed at the fixing roller pair 54. The fixing roller pair 54 is rotatably driven by the fixing motor M6 at a constant speed at an image forming speed V0. The image forming speed V0 is the same as a sheet conveyance speed at the secondary transfer nip portion T2. That is, the secondary transfer nip portion T2 conveys the sheet at the image forming speed V0, which is a fourth speed, while transferring the image onto the sheet. In this embodiment, the image forming speed V0 is set at 300 mm/s (millimeters per second). The sheet S is detected by the post-fixing sensor 55, and the control described later is performed based on a conveyance amount from a detection timing of the post-fixing sensor 55.

Then, the first switching member 61 is operated by the first switching motor M4, and, in a time of a face up discharge, guides the sheet S to the straight conveyance path 62. Thereafter, as shown in FIG. 5B, when a trailing edge of the sheet S has passed through the fixing roller pair 54, the sheet S is accelerated to a delivery speed V4 so as to deliver the sheet S to the inlet roller pair 121 of the discharge accessory 120. The control unit 400 controls the sheet discharge motor M1 and the decurler motor M3 so that an acceleration of the sheet S to the delivery speed V4 is performed.

In this embodiment, the delivery speed V4 is set at 600 mm/s. To be noted, a reason why the delivery speed V4 is set faster than the image forming speed V0 is to improve productivity by shortening a time from a feed to a discharge of the sheet S to the sheet discharge tray 130 of the discharge accessory 120 at the printer 1.

That is, after the trailing edge of the sheet S has passed through the fixing roller pair 54, it is necessary to accelerate the sheet S from the image forming speed V0 to the delivery speed V4 before a leading edge of the sheet S rushes into the inlet roller pair 121. Therefore, it is necessary that a length from the fixing roller pair 54 to the inlet roller pair 121 in the sheet conveyance direction is longer than a sum of a length of the sheet S having the longest length in specifications applicable to the printer 1 and a length required for the acceleration of the sheet S. Since it is necessary to proportionally lengthen the length from the fixing roller pair 54 to the inlet roller pair 121 to obtain the length required for the acceleration, it occurs that a size of the apparatus is increased. Therefore, it is possible to reduce the size of the apparatus in a case where a difference between the delivery speed V4 and the image forming speed V0 is small.

Face Down Discharge Control

Then, the face down discharge control in the first embodiment will be described. FIGS. 6A to 8 are the partial cross-sectional views showing the fixing unit 52, the branch conveyance unit 60, the inverse conveyance unit 80, the decurler unit 110, and the discharge accessory 120. The sheets S1 and S2 each are transfer materials conveyed in succession.

Figure 6A:
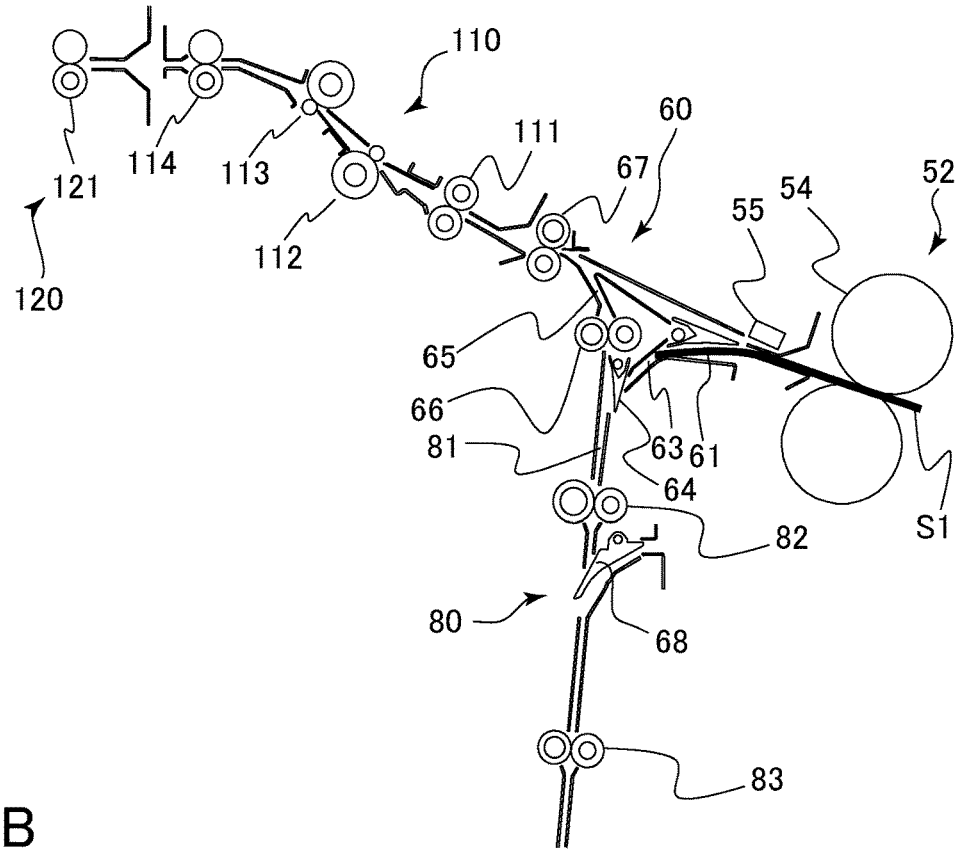
FIG. 6A is a cross-sectional view showing the aspect of the sheet in face down discharge control.

At first, as shown in FIG. 6A, the preceding sheet S1 is conveyed at the image forming speed V0 while being fixed with the visible color image on the sheet S1 at the fixing roller pair 54. At this point, the sheet S1 is detected by the post-fixing sensor 55, and the control described later is performed based on the conveyance amount from the detection timing of the post-fixing sensor 55.

Figure 6B:
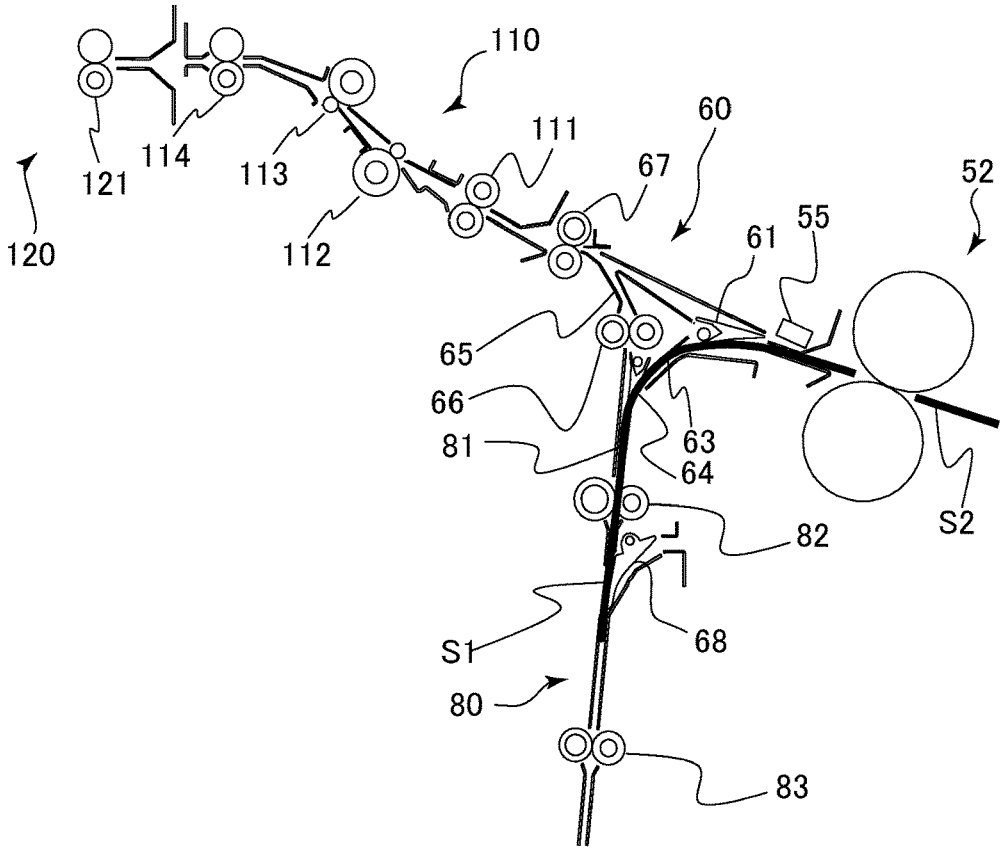
FIG. 6B is a cross-sectional view showing an aspect of the sheets in the face down discharge control.

In a case of the face down discharge control, the sheet S1 is guided to the pre-inverse and inverse conveyance paths 63 and 81 by the first switching member 61, and delivered to the upper reverse conveyance roller pair 82, serving as a reverse conveyance roller pair. Thereafter, as shown in FIG. 6B, when the trailing edge of the sheet S1 has passed through the fixing roller pair 54, the control unit 400 increases a rotational speed of the upper reverse conveyance roller pair 82 by the reverse motor M2, and accelerates a conveyance speed of the sheet S1 from the image forming speed V0 to a pre-reverse speed V1. In this embodiment, the pre-reverse speed V1, which is a fifth speed, is set at 1500 mm/s.

Figure 7A:
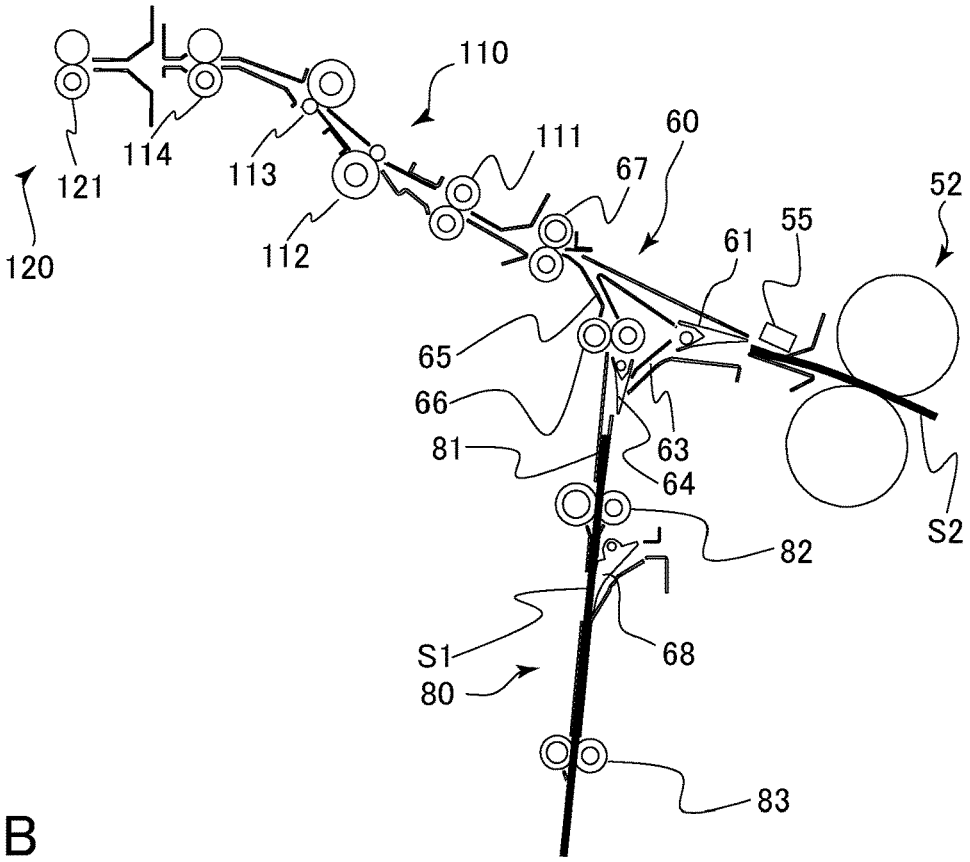
FIG. 7A is a cross-sectional view showing the aspect of the sheets in the face down discharge control.

Then, the sheet S1 is conveyed at the pre-reverse speed V1, and stopped at a reverse position shown in FIG. 7A. In this embodiment, the reverse position is a position where the trailing edge of the sheet S1 is apart from the upper reverse conveyance roller pair 82 by 30 mm upstream in the sheet conveyance direction when the trailing edge of the sheet S1 has reached the reverse position. To be noted, at the reverse position, the trailing edge of the sheet S1 is positioned below the second switching member 64. Further, at this time, the succeeding second sheet S2 is already passing through the fixing roller pair 54 at the image forming speed V0. In this embodiment, a sheet gap, which is a distance between the sheets S1 and S2 on which the image formation is in progress, is 40 mm.

After the sheet S1 has reached the reverse position, the upper reverse conveyance roller pair 82 starts rotation at a first post-reverse speed V2 in an opposite direction of a direction in which the sheet S1 has been conveyed, and conveys the sheet S1 to the sheet pre-discharge roller pair 66. That is, having conveyed in the first direction D1, the upper reverse conveyance roller pair 82 conveys the sheet S1 in the second direction D2 which is an opposite direction of the first direction D1. In this embodiment, the first post-reverse speed V2 is set at 1500 mm/s.

At this point, a reason why the pre-reverse speed V1 and the first post-reverse speed V2 are faster than the image forming speed V0 is to avoid the sheet S1 to come into contact with the sheet S2 succeeding the sheet S1. If the sheet S1 comes into contact with the sheet S2, an edge of the sheet comes into contact with the other sheet, and damage to the toner image and a jam occur. Therefore, by setting the pre-reverse speed V1 and the first post-reverse speed V2 to be faster than the image forming speed V0, the sheets are prevented from coming into contact with each other. In other words, the pre-reverse speed V1, the first post-reverse speed V2, and a second post-reverse speed V3 are set so that the sheet S1, which is the preceding sheet, and the sheet S2, which is the succeeding sheet, do not come into contact with each other.

Figure 7B:
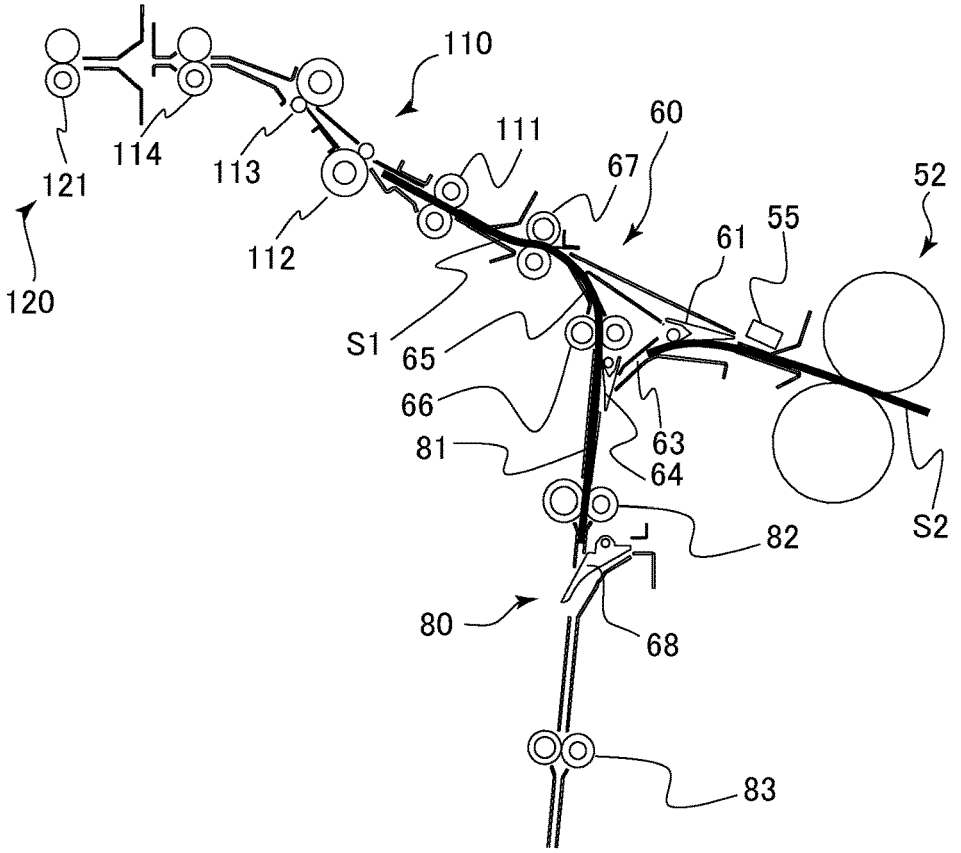
FIG. 7B is a cross-sectional view showing the aspect of the sheets in the face-down discharge control.

Then, the control unit 400, as shown in FIG. 7B, decelerates the conveyance speed of the sheet S1 from the first post-reverse speed V2 to the second post-reverse speed V3 before the sheet S1 rushes into the upstream curl correction roller pair 112. At this time, the conveyance speed of the sheet S1 is controlled by the sheet discharge motor M1, the reverse motor M2, and the decurler motor M3. In this embodiment, the second post-reverse speed V3 is set at 1000 mm/s. In this embodiment, the first post-reverse speed V2 is set faster than the second post-reverse speed V3 so that the sheets are prevented from coming into contact with each other. However, for example, so as to convey the sheet S1 at the first post-reverse speed V2 at the decurler unit 110, an electric power required to rotatably drive the upstream and downstream curl correction roller pairs 112 and 113 becomes too large. However, for example, so as to convey the sheet S1 at the first post-reverse speed V2 at the decurler unit 110, an electric power required to rotatably drive the upstream and downstream curl correction roller pairs 112 and 113 becomes too large.

So as to correct the curl, the upstream and downstream curl correction roller pairs 112 and 113 have a larger clamping force than the upper reverse conveyance roller pair 82 and the sheet discharge roller pair 67. That is, a drive load of the upstream curl correction roller pair 112 is larger than a drive load of the upper reverse conveyance roller pair 82. Therefore, since the drive loads required to rotatably drive the upstream and downstream curl correction roller pairs 112 and 113 are large, if the speed is fast, the electric power required for the decurler motor M3 is increased, and increases in a motor size and cost are led.

Accordingly, it is possible to reduce the increase in the cost by decelerating the sheet S1 in front of the upstream and downstream curl correction roller pairs 112 and 113 of the large drive load. However, since the sheets come into contact with each other if the conveyance speed of the sheet S1 in the decurler unit 110 is decreased to the delivery speed V4, the second post-reverse speed V3 is determined so that the sheets do not come into contact with each other. At this time, the succeeding sheet S2 is in a state of being conveyed to an adjacency of the third switching member 68 at the image forming speed V0.

Figure 8:
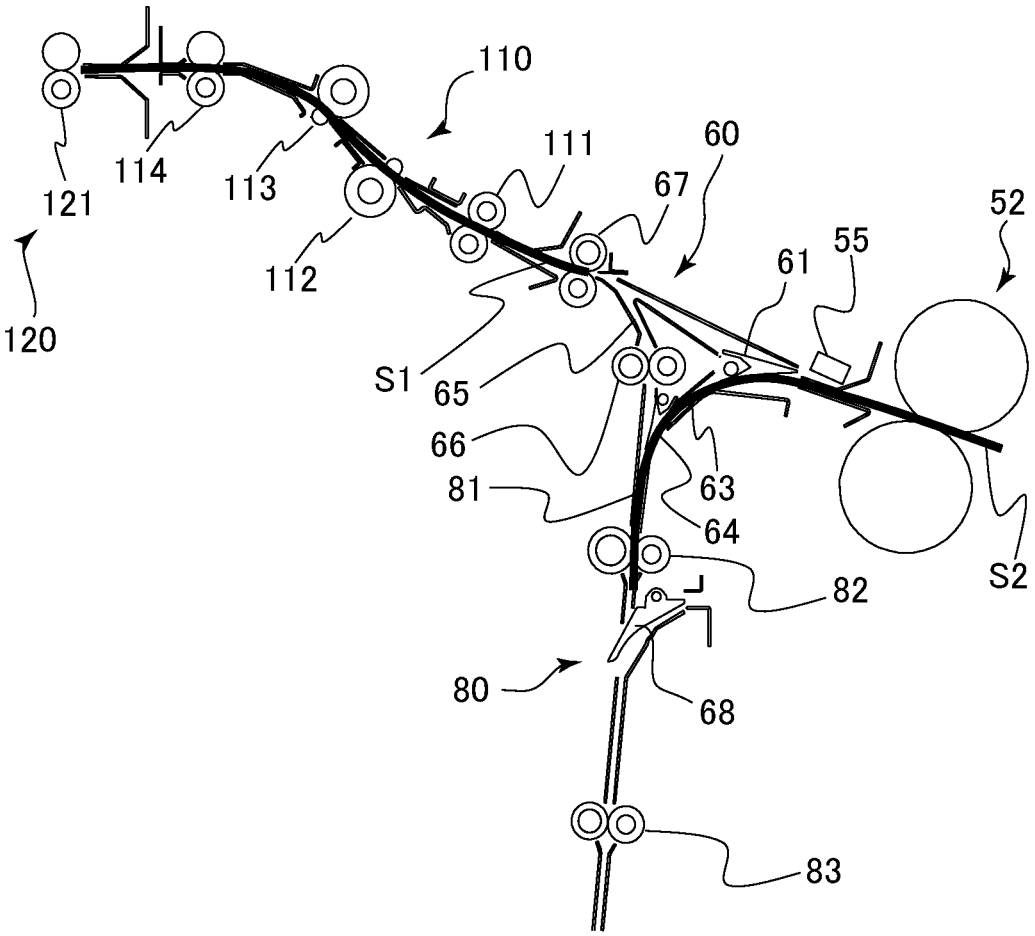
FIG. 8 is a cross-sectional view showing the aspect of the sheets in the face down discharge control.

Thereafter, as shown in FIG. 8, before the sheet S1 rushes into the inlet roller pair 121, the conveyance speed is decelerated from the second post-reverse speed V3 to the delivery speed V4. By setting the deliver speeds in the face up discharge control and the face down discharge control at the same, it is possible to deliver the sheet to the discharge accessory 120 without decreasing the productivity even in a case where the face up discharge control and the face down discharge control are performed in succession. At this time, the succeeding sheet S2 is in a state of reaching the third switching member 68.

Control in Face Down Discharge Control

Figure 9:
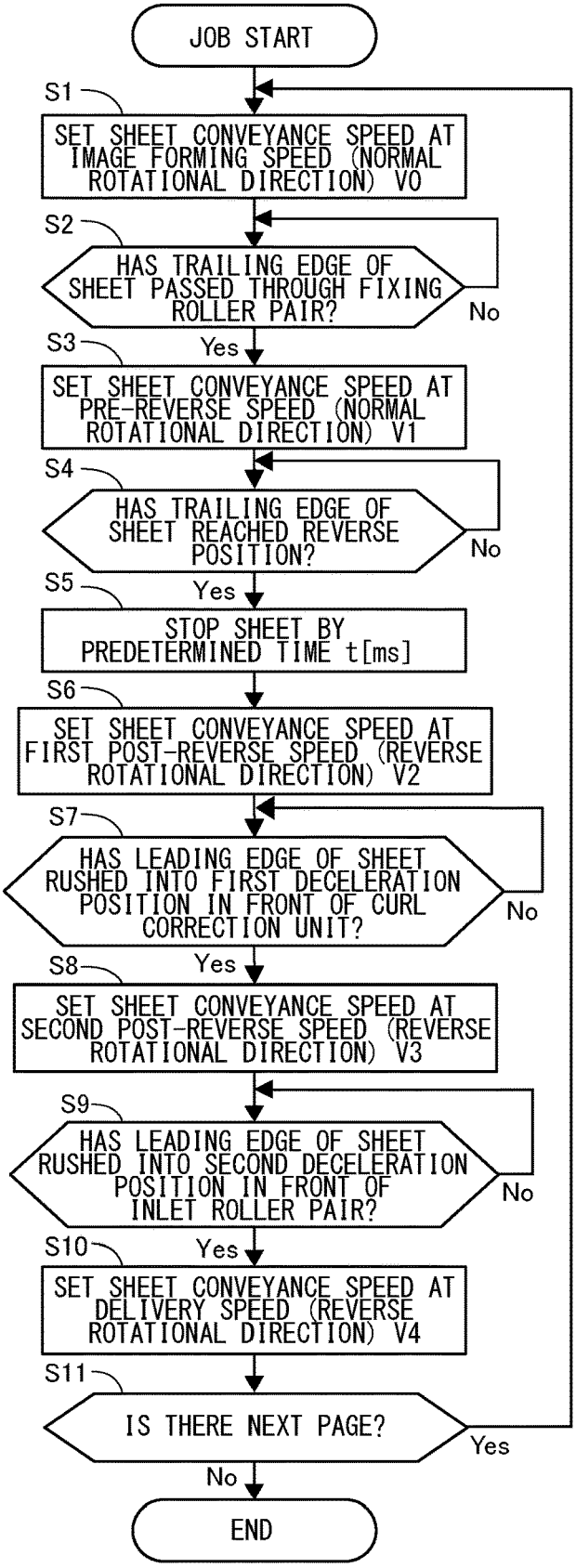
FIG. 9 is a flowchart showing the face down discharge control.

Next, control of the face down discharge control will be described along a flowchart shown in FIG. 9. At first, when a job of performing the face down discharge control is started, the control unit 400 drives the fixing motor M6 so that the conveyance speed of the sheet S1 becomes the image forming speed V0.

Next, the control unit 400 judges based on the detection result of the post-fixing sensor 55 whether or not the trailing edge of the sheet S1 has passed through the fixing roller pair 54 (STEP S2). In a case where it is judged that the trailing edge of the sheet S1 has passed through the fixing roller pair 54 (STEP S2: Yes), the control unit 400 drives the reverse motor M2 in a normal rotational direction so that the conveyance speed of the sheet S1 becomes the pre-reverse speed V1.

Next, the control unit 400 judges whether or not the trailing edge of the sheet S1 has reached the reverse position (STEP S4). In a case where it is judged that the trailing edge of the sheet S1 has reached the reverse position (STEP S4: Yes), so as to reverse the sheet S1, the control unit 400 stops the sheet S1 by a predetermined time period t by stopping the reverse motor M2.

Next, the control unit 400 drives the reverse motor M2 in a reverse direction so that the conveyance speed of the sheet S1 becomes the first post-reverse speed V2 (STEP S6). Next, the control unit 400 judges whether or not the leading edge of the sheet S1 has reached a first deceleration position in front of the curl correction portion 115 (refer to FIG. 3) (STEP S7). In a case where it is judged that the leading edge of the sheet S1 has reached the first deceleration position (STEP S7: Yes), the control unit 400 sets the conveyance speed of the sheet S1 at the second post-reverse speed V3 (STEP S8). At this time, the conveyance speed of the sheet S1 is controlled by the sheet discharge motor M1 driving in the reverse direction, the reverse motor M2, and the decurler motor M3.

Next, the control unit 400 judges whether or not the leading edge of the sheet S1 has reached a second deceleration position in front of the inlet roller pair 121 (STEP S9). In a case where it is judged that the leading edge of the sheet S1 has reached the second deceleration position (STEP S9: Yes), the control unit 400 drives the sheet discharge motor M1 and the decurler motor M3 in the reverse direction so that the conveyance speed of the sheet S1 becomes the delivery speed V4 (STEP S10). The sheet S1 is delivered to the inlet roller pair 121 of the discharge accessory 120 at the delivery speed V4.

Then, the control unit 400 judges whether or not there is a next page (STEP S11). In a case where there is the next page (STEP S11: Yes), the control unit 400 returns to STEP S1. In a case where there is not the next page (STEP S11: No), the control unit 400 ends the control.

As described above, the face down discharge control includes a first conveyance process, a second conveyance process, and a third conveyance process described below. The first conveyance process is a process to convey the sheet S1 by the upper reverse conveyance roller pair 82 in the second direction D2 at the first post-reverse speed V2, which is a first speed. The second conveyance process is a process to convey the sheet S1 toward the upstream curl correction roller pair 112 at the second post-reverse speed V3, which is a second speed and slower than the first post-reverse speed V2. The third conveyance process is a process to convey the sheet S1 to the inlet roller pair 121 at the delivery speed V4, which is a third speed and slower than the first and second post-reverse speeds V2 and V3. Further, the conveyance speed of the sheet S1 by the upper reverse conveyance roller pair 82 is set at the first post-reverse speed V2 in the first conveyance process, at the second post-reverse speed V3 in the second conveyance process, and at the delivery speed V4 in the third conveyance process.

Further, since the conveyance speeds of the sheet after the switchback include three speeds of the first post-reverse speed V2, the second post-reverse speed V3, and the delivery speed V4, it is possible to reduce the jam and image defects by preventing the sheets from rubbing each other. Further, it is possible to reduce the increase in the cost by avoiding the increases in the motor size and electric power to drive the large drive load rollers, for example, such as the upstream and downstream curl correction roller pairs 112 and 113.

Further, the image forming speed V0 is slower than the first post-reverse speed V2, the second post-reverse speed V3, and the delivery speed V4. That is, having been conveyed by the fixing roller pair 54 at the image forming speed V0, the sheet S1 is accelerated to the pre-reverse speed V1, and the first post-reverse speed V2 is also faster than the image forming speed V0. Herewith, it is possible to secure a time for switchbacking the sheet at the inverse conveyance unit 80, and possible to improve the productivity and decrease the size of the apparatus.

Second Embodiment

Although a second embodiment of the present disclosure will be described next, in the second embodiment, a cooling unit 140 is disposed instead of the decurler unit 110 of the first embodiment, and the upper reverse conveyance roller pair 82 is configured to be connectable and separable. Therefore, illustrations of configurations similar to the first embodiment will be omitted herein, or descriptions will be provided by putting the same reference characters on drawings.

Figure 10:
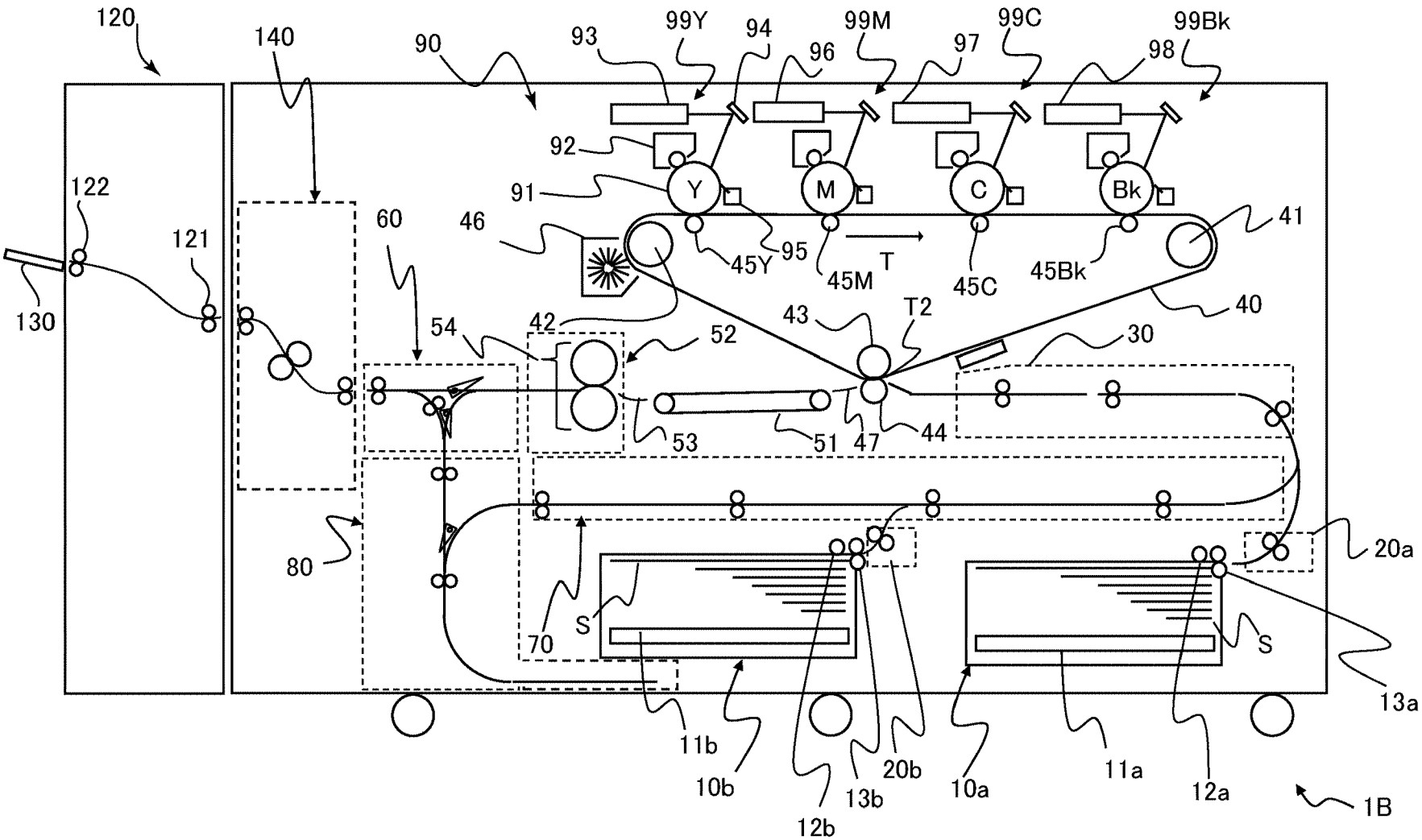
FIG. 10 is a diagram showing a schematic general view of a printer according to a second embodiment.

As shown in FIG. 10, a printer 1B which is the image forming apparatus according to this embodiment includes the cooling unit 140. The cooling unit 140 cools the sheet by taking heat from the sheet, and conveys the sheet S1 to the discharge accessory 120.

Cooling Unit

Figure 11:
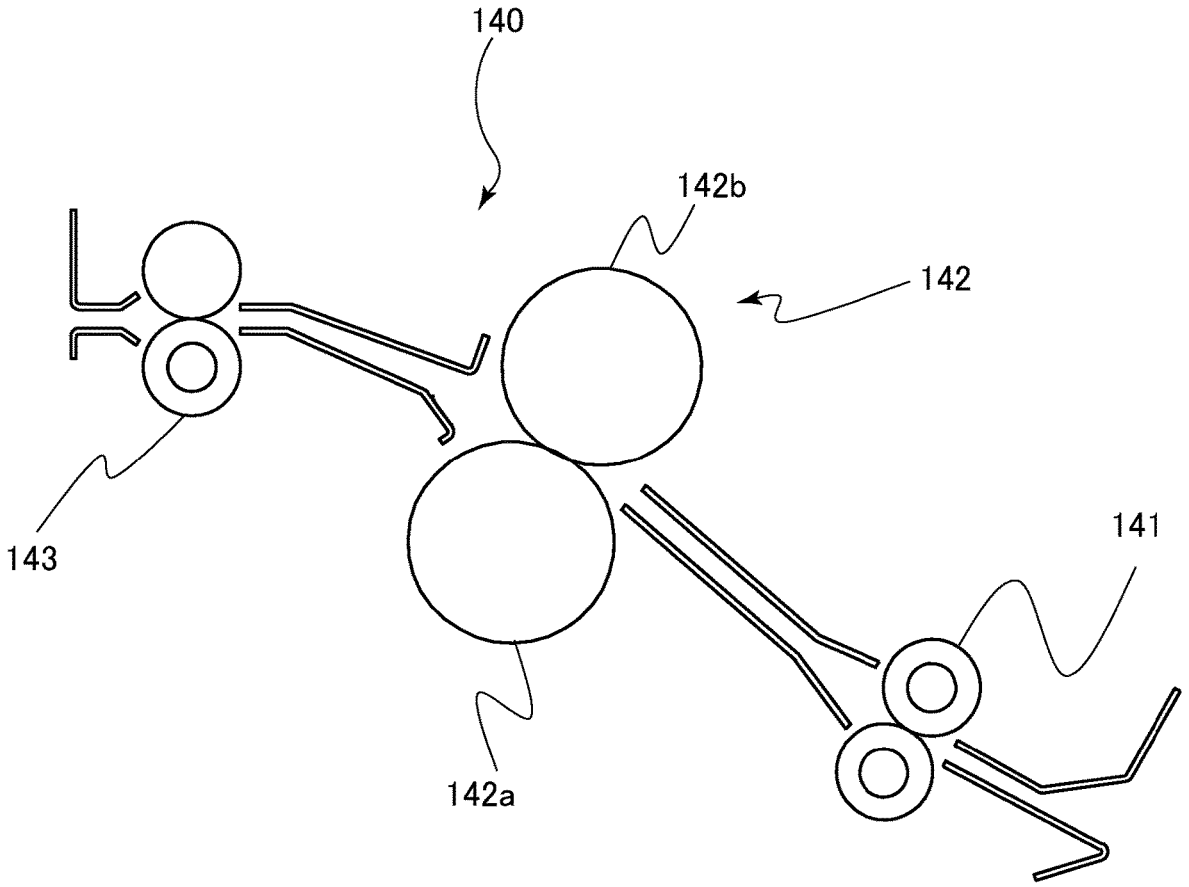
FIG. 11 is a cross-sectional view showing a cooling unit.

The cooling unit 140, as shown in FIG. 11, includes an upstream roller pair 141, a cooling roller pair 142, and a downstream roller pair 143. The upstream roller pair 141 receives the sheet S conveyed by the branch conveyance unit 60 to the cooling unit 140, and coveys the sheet S to the cooling roller pair 142.

The cooling roller pair 142 includes a cooling drive roller 142*a*, serving as a third conveyance roller, and a cooling driven roller 142*b*, serving as a fourth conveyance roller, rotatably driven by the cooling drive roller 142*a*. The cooling drive roller 142*a* is, for example, constituted by a rubber material, such as silicon, and driven by a cooling motor M7 (refer to FIG. 12). An outer periphery of the cooling driven roller 142*b* is constituted by, for example, a metallic material such as aluminum, and, by coming into contact with the sheet, cools the sheet S by transferring the heat from the sheet S to the cooling driven roller 142*b*.

In a case where the sheet S is discharged from the printer 1 with being hot, inconvenience of adhering and sticking of not solidified toner image to the stacked sheets occurs. Therefore, it is possible to prevent sticking of the toner image to the sheet by the cooling roller pair 142 which cools the sheet S and solidifies the toner image. The sheet S conveyed by the cooling roller pair 142 is delivered to the discharge accessory 120 by the downstream roller pair 143.

Control Block

Figure 12:
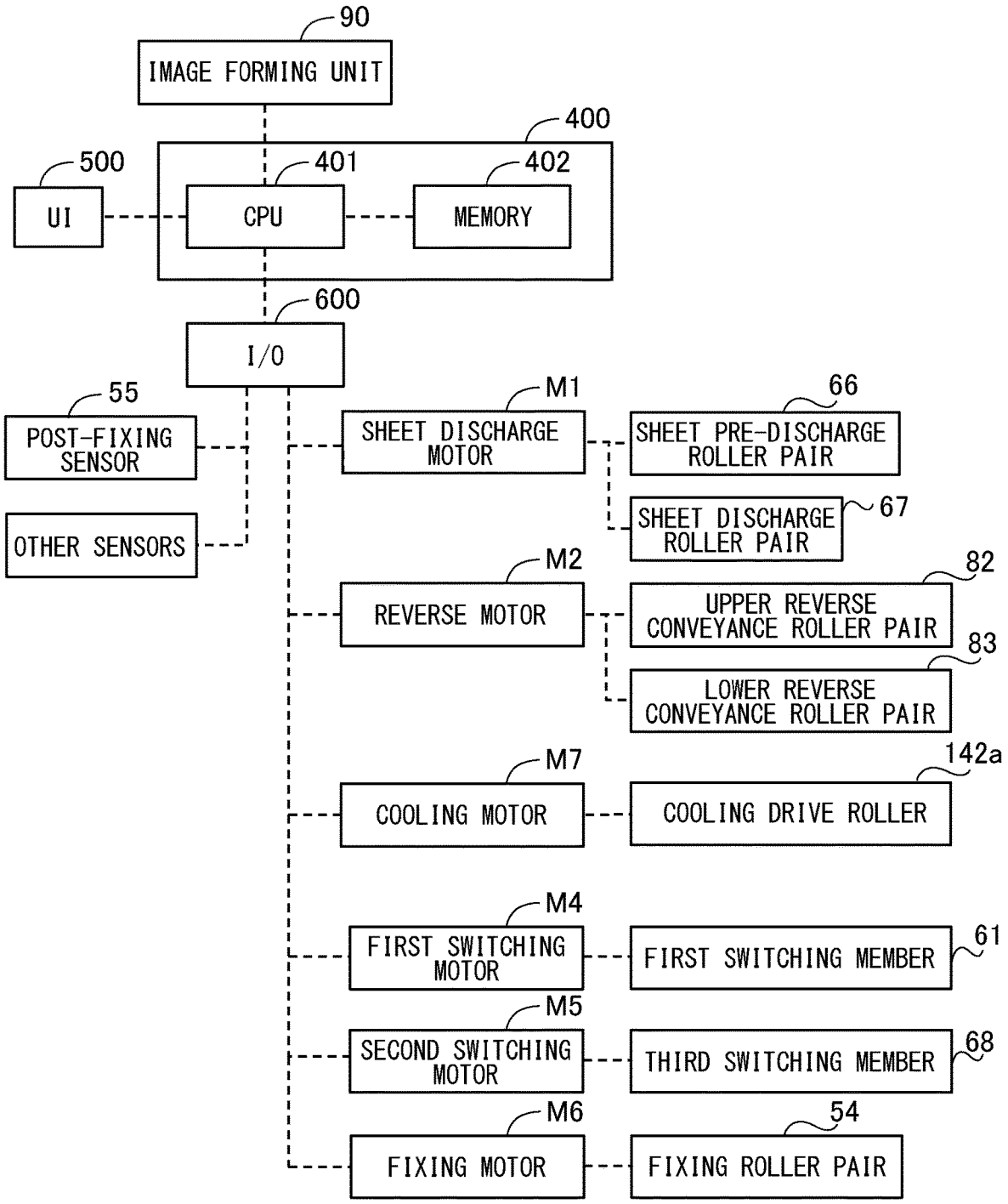
FIG. 12 is a block diagram showing a control block according to the second embodiment.

FIG. 12 is a control block diagram according to this embodiment. The control block diagram shown in FIG. 12 includes the cooling motor M7 instead of the decurler motor M3 of the control block diagram which has been already described in FIG. 4. The cooling motor M7 drives the cooling drive roller 142*a*.

Face Down Discharge Control

Then, face down discharge control of the second embodiment will be described. FIGS. 13A to 15B are partial cross-sectional views of the fixing unit 52, the branch conveyance unit 60, the reverse conveyance unit 80, the cooling unit 140, and the discharge accessory 120. The sheet S1 and S2 each are the transfer materials conveyed in succession.

Figure 13A:
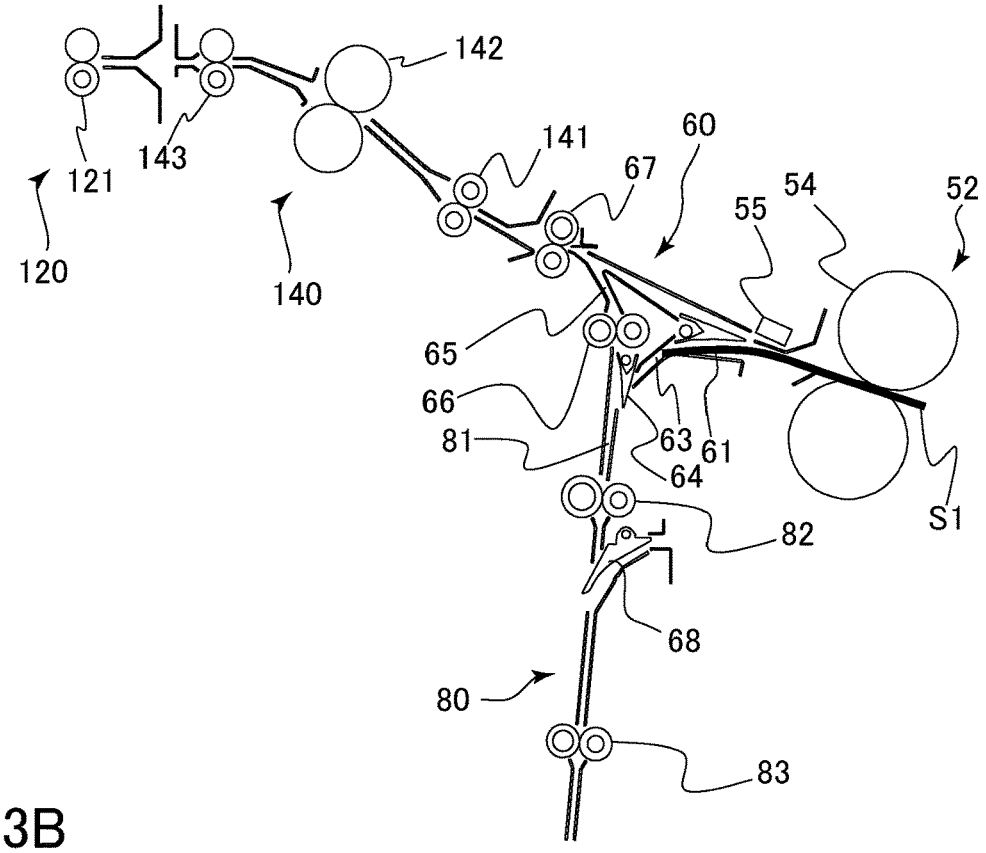
FIG. 13A is a cross-sectional view showing an aspect of the sheet in face down discharge control.

At first, as shown in FIG. 13A, the sheet S1 is conveyed at the image forming speed V0 while the visible color image is being fixed by the fixing roller pair 54. At this point, the sheet S1 is detected by the post-fixing sensor 55, and the control described later is performed based on the conveyance amount from the detection timing of the post-fixing sensor 55.

Figure 13B:
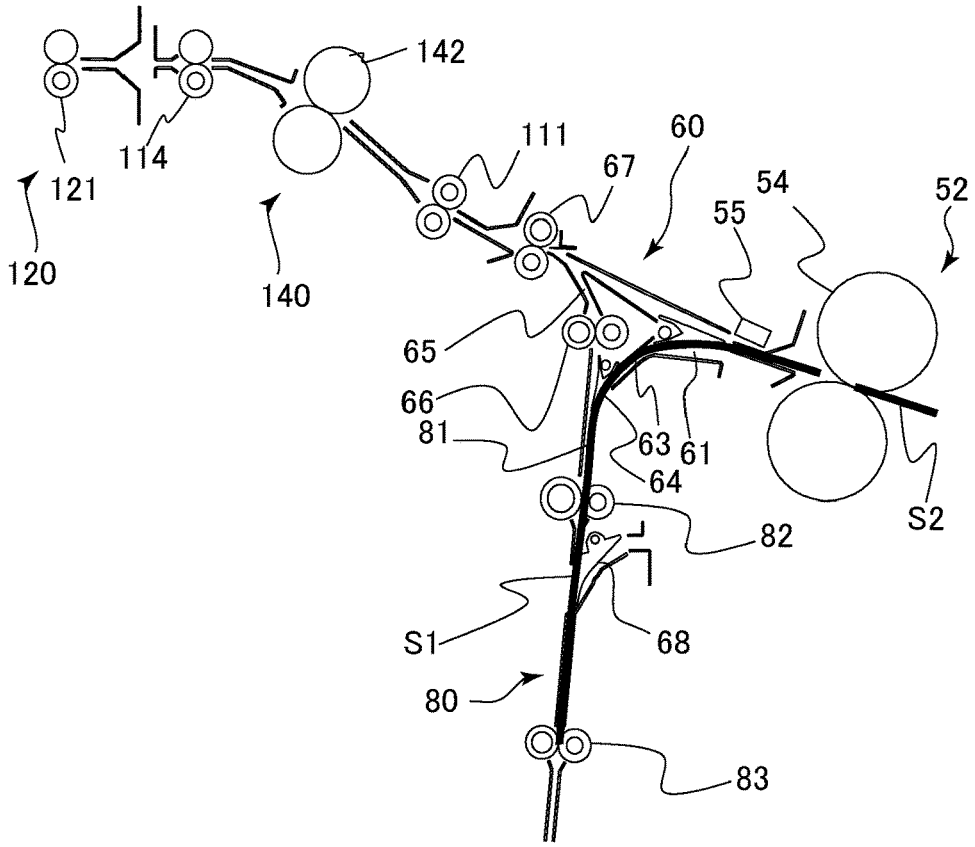
FIG. 13B is a cross-sectional view showing an aspect of the sheets in the face down discharge control.

In a case of the face down discharge control, the sheet S1 is guided to the pre-inverse and inverse conveyance paths 63 and 81 by the first switching member 61, and delivered to the upper reverse conveyance roller pair 82. Thereafter, as shown in FIG. 13B, when the trailing edge of the sheet S1 has passed through the fixing roller pair 54, the control unit 400 increases a rotational speed of the upper reverse conveyance roller pair 82 by the reverse motor M2, and accelerates the conveyance speed of the sheet S1 from the image forming speed V0 to the pre-reverse speed V1. In this embodiment, the pre-reverse speed V1 is set at 1500 mm/s.

Figure 14A:
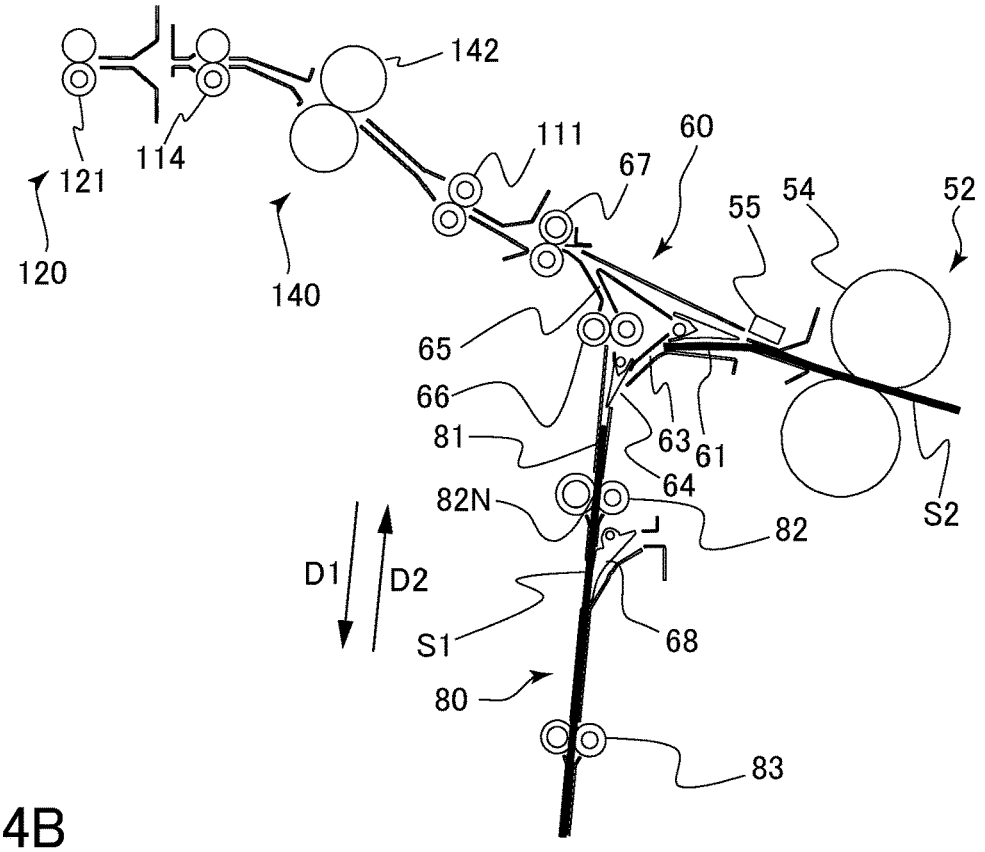
FIG. 14A is a cross-sectional view showing the aspect of the sheets in the face down discharge control.

Then, the sheet S1 is conveyed at the pre-reverse speed V1, and stopped at a reverse position shown in FIG. 14A. In this embodiment, the reverse position is a position where the trailing edge of the sheet S1 is apart from the upper reverse conveyance roller pair 82 by 30 mm upstream in the sheet conveyance direction when the trailing edge of the sheet S1 has reached the reverse position. Further, at this time, the succeeding second sheet S2 is already passing through the fixing roller pair 54 at the image forming speed V0. In this embodiment, the sheet gap which is the distance between the sheets S1 and S2 on which the image formation is in progress is set at 20 mm.

After the sheet S1 has reached the reverse position, the upper reverse conveyance roller pair 82 starts rotation at a first post-reverse speed V2 in an opposite direction of a direction in which the sheet S1 has been conveyed, and conveys the sheet S1 to the sheet pre-discharge roller pair 66. In this embodiment, the first post-reverse speed V2 is set at 1500 mm/s.

At this point, a reason why the pre-reverse speed V1 and the first post-reverse speed V2 are set to be faster than the image forming speed V0 is to shorten a contact time period of the sheet S1 with the sheet S2 succeeding the sheet S1. If the sheet S1 comes into contact with the sheet S2, an edge of the sheet comes into contact with the other sheet, and the damage to the toner image and the jam occur. Therefore, by setting the pre-reverse speed V1 and the first post-reverse speed V2 faster than the image forming speed V0, the contact time period of the sheet S1 with the sheet S2 is shortened, and possibilities of the damage to the toner image and the jam are reduced.

Figure 14B:
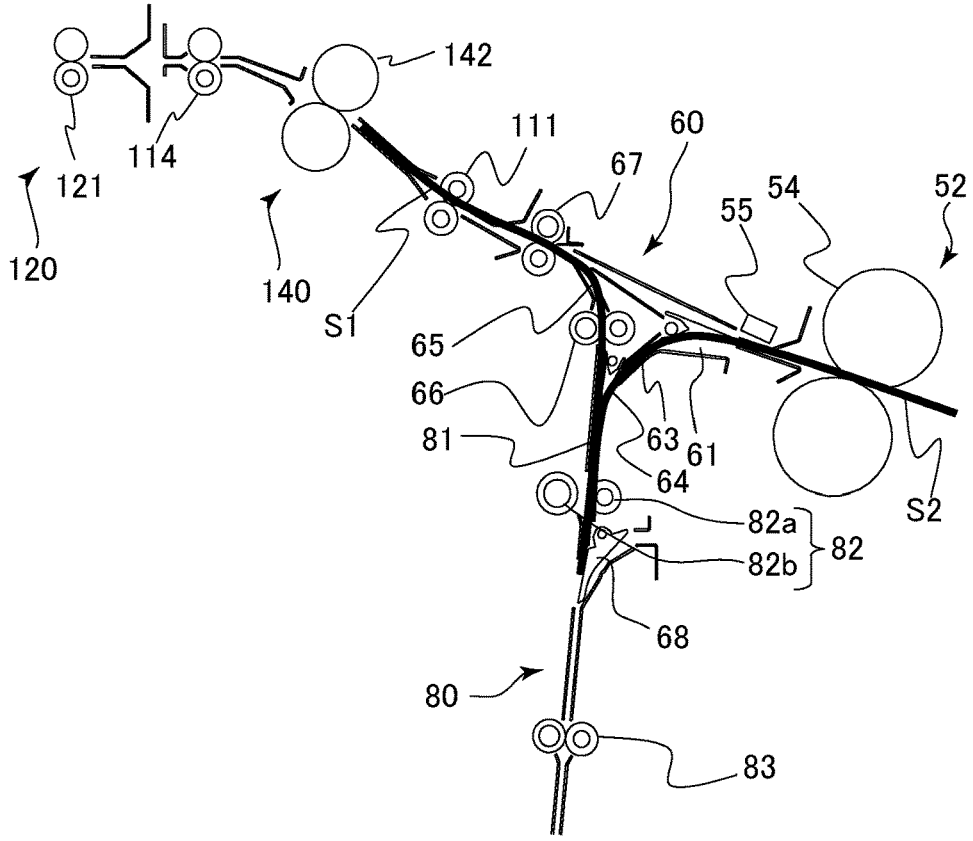
FIG. 14B is a cross-sectional view showing the aspect of the sheets in the face down discharge control.

Then, the control unit 400, as shown in FIG. 14B, controls the sheet discharge motor M1, the reverse motor M2, and the cooling motor M7 so as to decelerate the conveyance speed of the sheet S1 from the first post-reverse speed V2 to a second post-reverse speed V3 before the sheet S1 rushes into the cooling roller pair 142. In this embodiment, the second post-reverse speed V3 is set at 1000 mm/s.

Since the cooling driven roller 142*b* constituted by the metallic material is heavy, required torque for rotating the cooling roller pair 142 is larger than torque required for the other roller pairs, for example, such as the upper reverse conveyance roller pair 82. That is, a drive load of the cooling roller pair 142 is larger than a drive load of the upper reverse conveyance roller pair 82. As described above, the first post-reverse speed V2 is set faster than the second post-reverse speed V3 so as to shorten the contact time period during which the sheets come into contact with each other. However, if the sheet S1 is conveyed at the first post-reverse speed V2 also in the cooling unit 140, an electric power required to rotatably drive the cooling roller pair 142 becomes too large, and increases in a motor size and cost are led.

Accordingly, it is possible to reduce the increase in the cost by decelerating the sheet S1 in front of the cooling roller pair 142 of the large drive load. However, since the contact time period of the sheets is lengthened if the conveyance speed of the sheet S1 in the cooling unit 140 is decreased to the delivery speed V4, the second post-reverse speed V3 is determined so that the contact time period during which the sheets come into contact with each other becomes relatively short. At this time, the succeeding sheet S2 reaches the upper reverse conveyance roller pair 82.

In this embodiment, the upper reverse conveyance roller pair 82 is configured to be connectable and separable. More particularly, the upper reverse conveyance roller pair 82 includes a reverse drive roller 82*a*, serving as a first reverse roller, and a reverse driven roller 82*b*, serving as a second reverse roller, and the reverse driven roller 82*b* is capable of abutting and being separated onto and from the reverse drive roller 82*a* and capable of being rotatably driven by the reverse drive roller 82*a*. Further, the upper reverse conveyance roller pair 82 is capable of transitioning between an abutting state, where the reverse drive roller 82*a* and the reverse driven roller 82*b* abut each other and form a nip portion 82N (refer to FIG. 14A), and a separated state where the reverse drive roller 82*a* and the reverse driven roller 82*b* are separated from each other.

When the leading edge of the sheet S1 moves forward by a predetermined distance after having reached the sheet pre-discharge roller pair 66, the upper reverse conveyance roller pair 82 transitions from the abutting state to the separated state. By transitioning the upper reverse conveyance roller pair 82 to the separated state, it is possible to convey the preceding sheet S1 and the succeeding sheet S2 in a manner of rubbing each other between the reverse drive roller 82*a* and the reverse driven roller 82*b*. Then, even if the sheet gap between the sheets S1 and S2 is short, it is possible to switchback the sheet, and possible to improve the productivity along with reducing the size of the apparatus.

In this embodiment, when the leading edge of the sheet S1 reaches 30 mm downstream of the sheet pre-discharge roller pair 66 in the sheet conveyance direction, the upper reverse conveyance roller pair 82 starts to transition from the abutting state to the separated state. Then, in a timing of when the trailing edge of the sheet S1 has passed through the lower reverse conveyance roller pair 83, the upper and lower reverse conveyance roller pairs 82 and 83 are stopped driving, and thereafter rotated in the normal rotational direction so that the upper reverse conveyance roller pair 82 becomes a state capable of receiving the succeeding sheet S2.

As shown in FIG. 14B, when the preceding sheet S1 is being conveyed between the upper reverse conveyance roller pair 82 in the second direction D2, the succeeding sheet S2 is conveyed between the upper reverse conveyance roller pair 82 in the first direction D1. That is, the sheets S1 and S2 are conveyed in opposite directions in a state of overlapping each other.

Figure 15A:
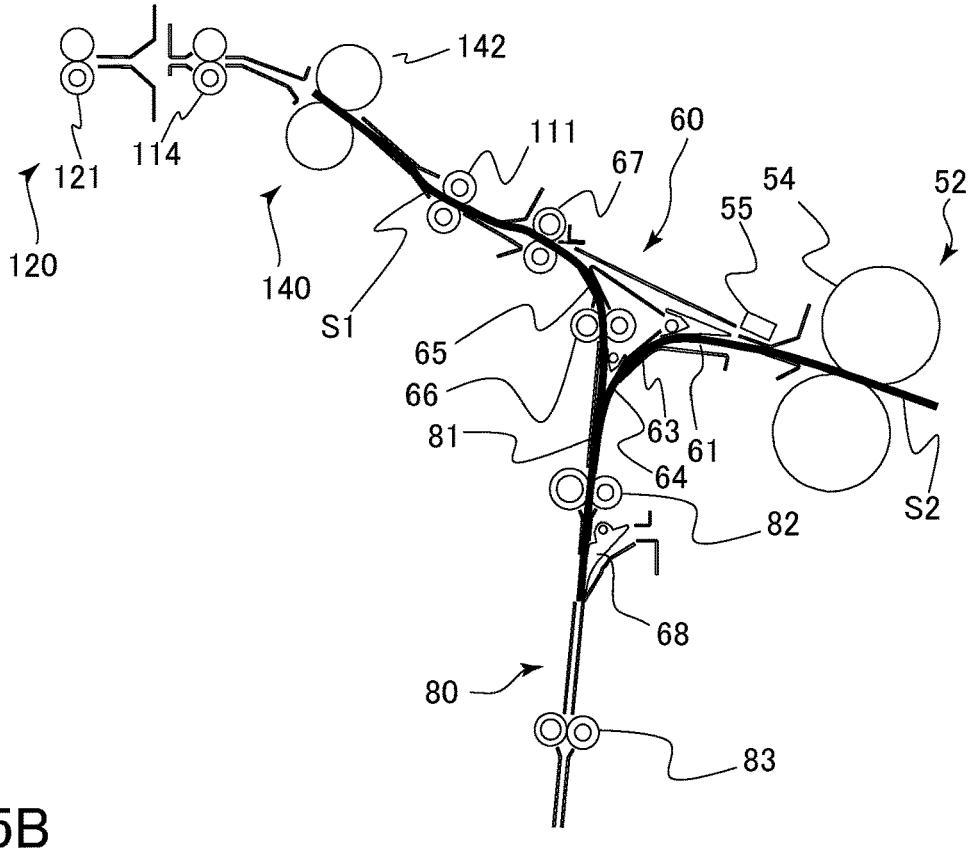
FIG. 15A is a cross-sectional view showing the aspect of the sheets in the face down discharge control.

Thereafter, as shown in FIG. 15A, when the trailing edge of the sheet S1 has passed through the upper reverse conveyance roller pair 82, the upper reverse conveyance roller pair 82 transitions from the separated state to the abutting state. In this state, the upper and lower reverse conveyance roller pairs 82 and 83 switchback the sheet.

Figure 15B:
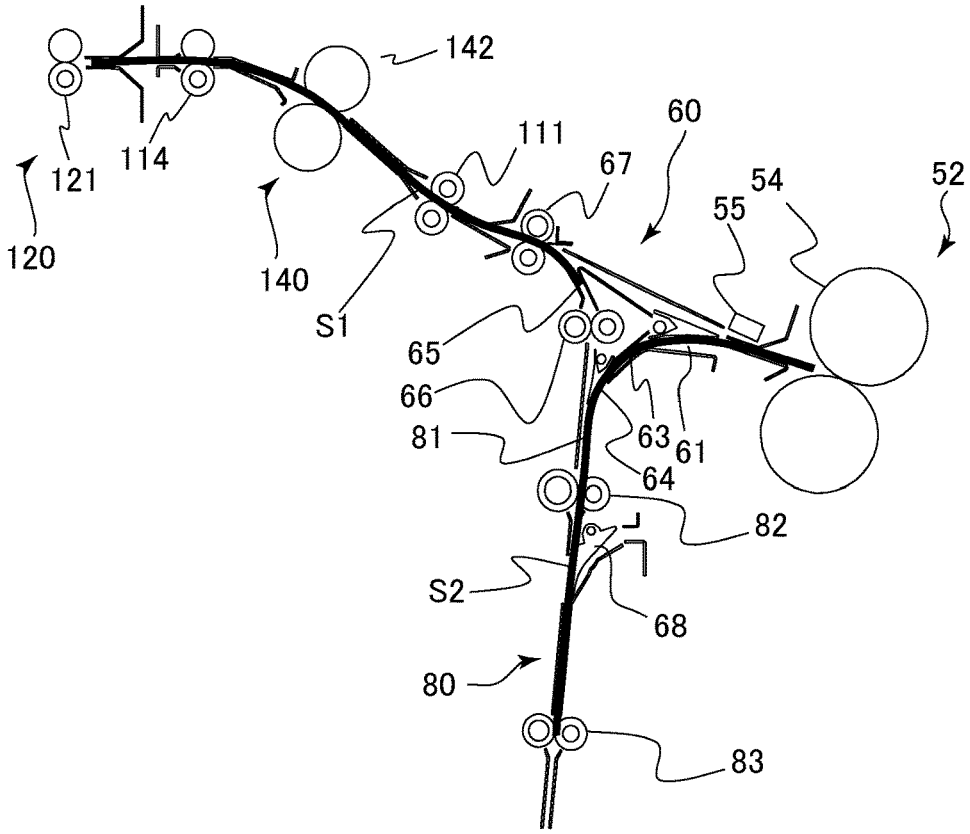
FIG. 15B is a cross-sectional view showing the aspect of the sheets in the face down discharge control.

Then, as shown in FIG. 15B, before the sheet S1 rushes into the inlet roller pair 121, the conveyance speed is decelerated from the second post-reverse speed V3 to the delivery speed V4. By setting the deliver speeds in the face up discharge control and the discharge accessory to be the same, it is possible to deliver the sheet to the discharge accessory 120 without decreasing the productivity even in a time when the face up discharge control and the face down discharge control are performed in succession. At this time, the succeeding sheet S2 is in a state of reaching the lower reverse conveyance roller pair 83.

As described above, the face down discharge control of this embodiment includes a first conveyance process, a second conveyance process, and a third conveyance process described below. The first conveyance process is a process to convey the sheet S1 by the upper reverse conveyance roller pair 82 in the second direction D2 at the first post-reverse speed V2, which is the first speed. The second conveyance process is a process to convey the sheet S1 toward the cooling roller pair 142 at the second post-reverse speed V3, which is the second speed and slower than the first post-reverse speed V2. The third conveyance process is a process to convey the sheet S1 to the inlet roller pair 121 at the delivery speed V4, which is the third speed and slower than the first and second post-reverse speeds V2 and V3. Further, the conveyance speed of the sheet S1 by the upper reverse conveyance roller pair 82 is set at the first post-reverse speed V2 in the first conveyance process, at the second post-reverse speed V3 in the second conveyance process, and at the delivery speed V4 in the third conveyance process.

Further, since the conveyance speeds of the sheet after the switchback include three speeds of the first post-reverse speed V2, the second post-reverse speed V3, and the delivery speed V4, it is possible to reduce the jam and image defects by reducing the time period during which the sheets rub each other. In other words, the pre-reverse speed V1, the first post-reverse speed V2, and the second post-reverse speed V3 are set so that the sheet S1 being conveyed in the second direction D2 and the sheet S2 being conveyed in the first direction D1 come into contact with each other between the reverse drive roller 82*a* and the reverse driven roller 82*b*. Further, it is possible to suppress the increase in the cost by preventing the increases in the size and electric power of the motor to drive the large drive load rollers, for example, such as the cooling roller pair 142.

Other Embodiments

To be noted, although, in any of the embodiments described above, the upstream curl correction roller pair 112 and the cooling roller pair 142 are described as examples of conveyance roller pairs requiring larger drive load than the upper reverse conveyance roller pair 82, it is not limited to this. For example, it is acceptable to apply a comb-teeth roller pair, in which two rollers are disposed so as to overlap each other when viewed in an axial direction, as the conveyance roller pair described above.

Further, although, in any of the embodiments described above, the delivery speed V4 is set at slower than the first post-reverse speed V2 and the second post-reverse speed V3, it is not limited to this. For example, it is acceptable to set the delivery speed V4 at slower than the first post-reverse speed V2 and faster than the second post-reverse speed V3. Further, for example, it is acceptable to set the delivery speed V4 faster than the first post-reverse speed V2 and the second post-reverse speed V3.

Further, although, in the second embodiment, the reverse driven roller 82*b* is configured to be capable of abutting and being separated onto and from the reverse drive roller 82*a*, it is not limited to this. For example, it is acceptable that the reverse drive roller 82*a* is capable of abutting and being separated onto and from the reverse driven roller 82*b*, and that the reverse drive roller 82*a* and the reverse driven roller 82*b* are capable of abutting and being separated onto and from each other.

Further, although, in the second embodiment, the outer periphery of the reverse driven roller 82*b* is constituted by the metallic material, it is not limited to this. For example, it is acceptable that an outer periphery of the reverse drive roller 82*a* is constituted by the metallic material, and that both of the outer peripheries of the reverse drive roller 82*a* and the reverse driven roller 82*b* are constituted by the metallic material. That is, the outer periphery of at least one of the reverse drive roller 82*a* and the reverse driven roller 82*b* is constituted by the metallic material.

Further, in any of the embodiments described above, relations between the motors and the roller pairs driven by the motors are not limited to the relations described in FIGS. 4 and 12, and it is acceptable to set the relations arbitrarily. Further, it is acceptable to control the timing of changing the sheet conveyance speed not based on the detection result of the post-fixing sensor 55 but based on the other sensors, a motor load, and the like.

Further, although, in the first embodiment, the sheets S1 and S2 are configured not to come into contact with each other, it is acceptable to convey the sheets S1 and S2 in a manner of passing each other similarly to the second embodiment. Further, it is acceptable to apply the decurler unit 110 of the first embodiment instead of the cooling unit 140 of the second embodiment.

Further, although, in any of the embodiments described above, the descriptions are provided using the printer of the electrophotographic system, the present disclosure is not limited to this. For example, it is possible to apply the present disclosure to an image forming apparatus of an ink jet system which forms the image on the sheet by ejecting a liquid ink through a nozzle.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-086421, filed May 18, 2020, which is hereby incorporated by reference herein in its entirety.

What is claimed is:

1. An image forming apparatus coupled to a downstream apparatus and delivering a sheet to an inlet roller pair provided on the downstream apparatus, the image forming apparatus comprising:

an image forming unit configured to form an image on the sheet;

a reverse conveyance roller pair configured to convey the sheet in a first direction, and thereafter convey the sheet in reverse in a second direction opposite to the first direction so as to switchback the sheet on which the image is formed by the image forming unit;

a decurler configured to correct a curl of the sheet conveyed by the reverse conveyance roller pair and convey the sheet;

a conveyance roller pair configured to convey the sheet whose curl is corrected by the decurler toward the inlet roller pair; and a control unit configured to control a conveyance speed of the sheet conveyed by the reverse conveyance roller pair, the decurler, and the conveyance roller pair, wherein the control unit is configured to perform a first conveyance process in which the sheet is conveyed in the second direction at a first speed by the reverse conveyance roller pair, a second conveyance process in which the sheet is conveyed at a second speed by the decurler, and a third conveyance process in which the sheet is conveyed to the inlet roller pair at a third speed by the conveyance roller pair, the second speed being slower than the first speed, the third speed being different from the first and second speeds, wherein the image forming unit is configured to convey the sheet at a fourth speed while transferring the image onto the sheet, the fourth speed being slower than the first speed, the second speed, and the third speed.

2. The image forming apparatus according to claim 1, wherein the third speed is slower than the second speed.

3. The image forming apparatus according to claim 1, wherein the control unit is configured to control that the conveyance speed of the sheet by the reverse conveyance roller pair is set from the first speed to the second speed in the second conveyance process, and is set from the second speed to the third speed in the third conveyance process.

4. The image forming apparatus according to claim 1, wherein the control unit is configured to drive the reverse conveyance roller pair such that the sheet is conveyed in the first direction at a fifth speed after a trailing edge of the sheet has passed through the image forming unit, the fifth speed being slower than the fourth speed.

5. The image forming apparatus according to claim 4, wherein the first, second, and fifth speeds are set such that preceding and succeeding sheets do not come into contact with each other.

6. The image forming apparatus according to claim 4, wherein the reverse conveyance roller pair comprises a first reverse conveyance roller and a second reverse conveyance roller, and the first and second reverse conveyance rollers are configured to transition between an abutting state where the first and second reverse conveyance rollers abut each other and form a nip portion and a separated state where the first and second reverse conveyance rollers are separated from each other, and wherein the first, second, and fifth speeds are set such that a preceding sheet being conveyed in the second direction and a succeeding sheet being conveyed in the first direction come into contact with each other between the first and second reverse conveyance rollers of the reverse conveyance roller pair which is in the separated state.

7. The image forming apparatus according to claim 1, wherein the decurler comprises a first conveyance roller having a first outer diameter and a second conveyance roller having a second outer diameter, and is configured to correct the curl of the sheet by a nip portion formed by the first and second conveyance rollers, the second outer diameter being larger than the first outer diameter.

8. The image forming apparatus according to claim 1, wherein the conveyance roller pair comprises a third conveyance roller and a fourth conveyance roller, and wherein an outer periphery of at least one of the third and fourth conveyance rollers comprises a metallic material, and is configured to cool the sheet by coming into contact with the sheet.

9. The image forming apparatus according to claim 1, wherein the control unit comprises a first discharge mode in which the sheet passed through the image forming unit is discharged to the decurler without passing the reverse conveyance roller pair, and a second discharge mode in which the sheet passed through the image forming unit is reversed by the reverse conveyance roller pair and thereafter conveyed to the decurler.

10. The image forming apparatus according to claim 9, wherein a conveyance speed of the sheet conveyed to the inlet roller pair in the first discharge mode is equal to a conveyance speed of the sheet conveyed to the inlet roller pair in the second discharge mode.

* * * * *